US009252508B2

(12) United States Patent
Endo et al.

(10) Patent No.: US 9,252,508 B2
(45) Date of Patent: Feb. 2, 2016

(54) ELECTRIC CONNECTOR WITH DEFORMABLE TERMINALS

(71) Applicant: DAI-ICHI SEIKO CO., LTD., Kyoto (JP)

(72) Inventors: Takayoshi Endo, Shizuoka (JP); Sakai Yagi, Shizuoka (JP); Takuya Takeda, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 7 days.

(21) Appl. No.: 13/937,601

(22) Filed: Jul. 9, 2013

(65) Prior Publication Data

US 2014/0017914 A1 Jan. 16, 2014

(30) Foreign Application Priority Data

Jul. 10, 2012 (JP) ..... 2012-154902

(51) Int. Cl.

| | |
|---|---|
| ***H01R 12/52*** | (2011.01) |
| ***H01R 9/00*** | (2006.01) |
| ***H01R 12/70*** | (2011.01) |
| ***H01R 13/422*** | (2006.01) |
| ***H01R 12/73*** | (2011.01) |
| *H01R 12/58* | (2011.01) |

(52) U.S. Cl.

CPC ..... *H01R 9/00* (2013.01); *H01R 12/7082* (2013.01); *H01R 12/73* (2013.01); *H01R 13/422* (2013.01); *H01R 12/585* (2013.01); *H01R 12/7023* (2013.01)

(58) Field of Classification Search

CPC ..... H01R 13/631; H01R 9/00; H01R 12/73; H01R 12/58; H01R 12/7082; H01R 13/422

USPC ..... 439/81, 82, 74

See application file for complete search history.

(56) References Cited

U.S. PATENT DOCUMENTS

| | | | | | |
|---|---|---|---|---|---|
| 3,539,965 | A * | 11/1970 | Morehart et al. | ..... | 439/75 |
| 4,664,458 | A * | 5/1987 | Worth | ..... | 439/82 |
| 4,938,703 | A * | 7/1990 | Nakano | ..... | 439/74 |
| 5,340,319 | A * | 8/1994 | Enomoto et al. | ..... | 439/75 |
| 6,042,423 | A * | 3/2000 | Murr et al. | ..... | 439/590 |
| 6,623,280 | B2 * | 9/2003 | Oldenburg et al. | ..... | 439/75 |

(Continued)

FOREIGN PATENT DOCUMENTS

| | | |
|---|---|---|
| JP | 4-29196 | 1/1992 |
| JP | 7-230862 | 8/1995 |

(Continued)

OTHER PUBLICATIONS

Extended European Search Report issued Sep. 24, 2014 in corresponding European patent application No. 13174049.0.

*Primary Examiner* — Felix O Figueroa
*Assistant Examiner* — Paul Baillargeon
(74) *Attorney, Agent, or Firm* — Wenderoth, Lind & Ponack, L.L.P.

(57) ABSTRACT

An electric connector includes at least one terminal pin having, at opposite ends thereof, terminals to be inserted into through-holes formed through printed circuit boards spaced away from and facing each other, and an aligner for aligning the terminal pins in a row in such a condition that the terminal pins are movable relative to the aligner, the terminal pin including a movement-limiter which restricts movement of the terminal pin in a direction of an axis thereof.

7 Claims, 28 Drawing Sheets

(56) References Cited

U.S. PATENT DOCUMENTS

| | | | | |
|---|---|---|---|---|
| 2007/0087592 | A1* | 4/2007 | Thomson et al. | 439/78 |
| 2008/0050947 | A1 | 2/2008 | Nunokawa et al. | |
| 2011/0051389 | A1 | 3/2011 | Goto | |
| 2012/0156898 | A1 | 6/2012 | Kallee | |

FOREIGN PATENT DOCUMENTS

| | | |
|---|---|---|
| JP | 2011-124027 | 6/2011 |
| JP | 2011-141993 | 7/2011 |
| JP | 2011-253991 | 12/2011 |

* cited by examiner

ELECTRIC CONNECTOR WITH DEFORMABLE TERMINALS

BACKGROUND OF THE INVENTION

1. Field of the Invention

The invention relates to an electric connector electrically connecting two printed circuit boards spaced away from and facing each other, and further to a terminal pin employed in the electric connector.

2. Description of the Related Art

There is known an electric connector including a plurality of bar-shaped terminal pins aligned in a row. Terminals formed at one of ends of the terminal pins are inserted into through-holes formed through a first printed circuit board, and terminals formed at the other ends of the terminals are inserted into through-holes formed through a second printed circuit board, thereby electric circuits mounted on the first and second printed circuit boards are electrically connected to each other.

FIG. 27 is a perspective view of the connector disclosed in Japanese Patent Publication No. H4(1992)-29196, and FIG. 28 is a cross-sectional view of the connector sandwiched between two printed circuit boards.

As illustrated in FIG. 27, the connector includes a plurality of terminal pins 101. As illustrated in FIG. 28, each of the terminal pins 101 is bent by about 90 degrees at a lower end, and is soldered onto a first printed circuit board P1 at the L-shaped lower end. Further, each of the terminal pins 101 is inserted into a female connector 102 mounted on a second printed circuit board P2.

FIG. 29 is a perspective view of the pin header disclosed in Japanese Patent Application Publication No. H7(1995)-230862.

As illustrated in FIG. 29, a plurality of terminal pins 103 are supported with an upper holder 104 and a lower holder 105 each formed at upper and lower ends of board 106. The board 106 includes a plurality of projections 107 horizontally aligned at a central zone of the board 106. Each of the projections 107 is located in a space formed between the adjacent terminal pins 103 to thereby electrically insulate the adjacent terminal pins 103 from each other.

In an electric connector electrically connecting printed circuit boards to each other through terminal pins aligned in a row, a positional relation between the printed circuit boards is quite important. For instance, when printed circuit boards are connected to each other by inserting terminal pins into through-holes formed through the printed circuit boards, if a position relation between the printed circuit boards is deflected, the terminal pins might not be able to be inserted into one of the printed circuit board, even if the terminal pins can be inserted into the other printed circuit board. In particular, in the case a plurality of electric connectors is employed, there is a high possibility that the terminal pins cannot be inserted into one of the printed circuit boards.

In the above-mentioned connector disclosed in Japanese Patent Publication No. H4(1992)-29196, since one of the terminals of the terminal pin 101 is connected to the second printed circuit board P2 through the female connector 102, even if a positional relation between the first and second printed circuit boards P1 and P2 were slightly deflected, it is considered that the female connector 102 can absorb the deflection. However, the connector has to include the female connector 102 in order to absorb the deflection in a positional relation between the first and second printed circuit boards P1 and P2, a number of parts in the connector is not avoidable from increasing.

In the pin header disclosed in Japanese Patent Application Publication No. H7(1995)-230862, though the terminal pins 103 are inserted directly into printed circuit boards, the terminal pins 103 are merely held by the upper holder 104 and the lower holder 105, and each of the projections 107 merely separates the adjacent terminal pins 103 from each other. Consequently, if a positional relation between the printed circuit boards is deflected, since positions of the terminal pins 103 and a space between the adjacent terminal pins 103 are restricted by the upper holder 104 and the lower holder 105, even if the terminal pins 103 were able to be inserted into through-holes formed through one of the printed circuit boards, the terminal pins 103 might not be able to be inserted into through-holes formed through the other printed circuit board.

SUMMARY OF THE INVENTION

In view of the above-mentioned problems in the conventional connectors, it is an object of the present invention to provide an electric connector capable of causing terminals thereof to be able to be surely inserted into printed circuit boards, and thereby, enhancing connectability.

In one aspect of the present invention, there is provided an electric connector including at least one terminal pin having, at opposite ends thereof, terminals to be inserted into through-holes formed through printed circuit boards spaced away from and facing each other, and an aligner for aligning the terminal pins in a row in such a condition that the terminal pins are movable relative to the aligner, the terminal pin including a movement-limiter which restricts movement of the terminal pin in a direction of an axis thereof.

In the electric connector in accordance with the present invention, even if a positional relation between printed circuit boards were deflected, since the terminal pins are supported by aligner in such a condition that the terminal pins are movable relative to the aligner, it is possible to deflect the terminals of the terminal pins towards through-holes to thereby insert the terminals into the through-holes. Since the terminal pins are restricted by the movement-limiter with respect to the movement in an axial direction, the terminals of the terminal pins can be inserted into through-holes of printed circuit boards, even if the terminal pins are movable relative to the aligner.

It is preferable that the terminal pin includes a buffer zone which is deformable in accordance with displacement of an axis of the terminal pin. By designing the terminal pin to include the buffer zone, excessive force caused by deflection of an axis of the terminal pin does not act on the terminals of the terminal pin. Thus, it is possible to insert one of the terminals of the terminal pin into a printed circuit board without any problems with the other terminal being already inserted into another printed circuit board.

The buffer zone may be designed to comprise a plurality of resilient pieces. Each of the resilient pieces can be deformed in accordance with a direction in which an axis of the terminal pin deflects. Furthermore, even if an intensive current were to run through printed circuit boards, the buffer zone allows the current to run therethrough.

It is preferable that the buffer zone has a central portion closer to an axis of the terminal pin than both ends of the buffer zone.

The buffer zone may be designed to comprise a resilient piece including a smaller width portion than the rest of the resilient piece. Since the buffer zone can be readily bent at the portion, the portion can be deformed in accordance with the deflection of an axis of the terminal pin.

It is preferable that the movement-limiter extends radially from the terminal pin.

It is preferable that the terminal pin includes two movement-limiters between which the buffer zone is formed, each of the two movement-limiters extending radially from the terminal pin.

For instance, the aligner may be designed to include a support extending in a direction in which the terminal pins are aligned, a plurality of pairs of claws extending from the support and guiding the terminal pin having been inserted thereinto to a storage space with being resiliently deformed, and a projection extending into the storage space and keeping the terminal pin in the storage space. By so designing the aligner, it is possible to align the terminal pins in the aligner by inserting the terminal pins into the storage spaces after the support has been fabricated.

It is preferable that electric connector includes the aligner includes a pair of claws extending from the support and guiding the terminal pin having been inserted thereinto to a storage space with being resiliently deformed, at least one of the claws aligns the terminal pins in such a condition that the terminal pins are movable relative to the aligner, and the movement-limiter includes a pair of projections making contact with either inner or outer side of the aligner to restrict movement of the terminal pin in a direction of an axis of the terminal pin. By so designing the aligner, the terminal pins are not allowed to move in an axial direction thereof, even if the terminal pins are set movable relative to the aligner.

In another aspect of the present invention, there is provided a terminal pin to be sandwiched between two printed circuit boards spaced away from and facing each other, in such a condition that the terminal pin is supported by an electric connector, the terminal pin including terminals formed at opposite ends and to be inserted into through-holes formed through the printed circuit boards, and a movement-limiter which restricts movement of the terminal pin in a direction of an axis thereof.

It is preferable that the terminal pin further includes a buffer zone which is deformable in accordance with displacement of an axis of the terminal pin.

For instance, the buffer zone may be designed to comprise a plurality of resilient pieces.

For instance, the buffer zone may be designed to have a central portion closer to an axis of the terminal pin than both ends of the buffer zone.

For instance, the buffer zone may be designed to comprise a resilient piece including a smaller width portion than the rest of the resilient piece.

It is preferable that the movement-limiter extends radially from the terminal pin.

It is preferable that the terminal pin includes two movement-limiters between which the buffer zone is formed, each of the two movement-limiters extending radially from the terminal pin.

The advantages obtained by the aforementioned present invention will be described hereinbelow.

In accordance with the present invention, the terminals of the terminal pin can be deflected towards through-holes of printed circuit boards. Accordingly, even if a positional relation between printed circuit boards were deflected, it would be possible to surely insert the terminals of the terminal pins into the printed circuit boards, ensuring enhancement of the connectability.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

The electric connector 10 in accordance with the first embodiment is explained hereinbelow with reference to the drawings.

Figure 1:
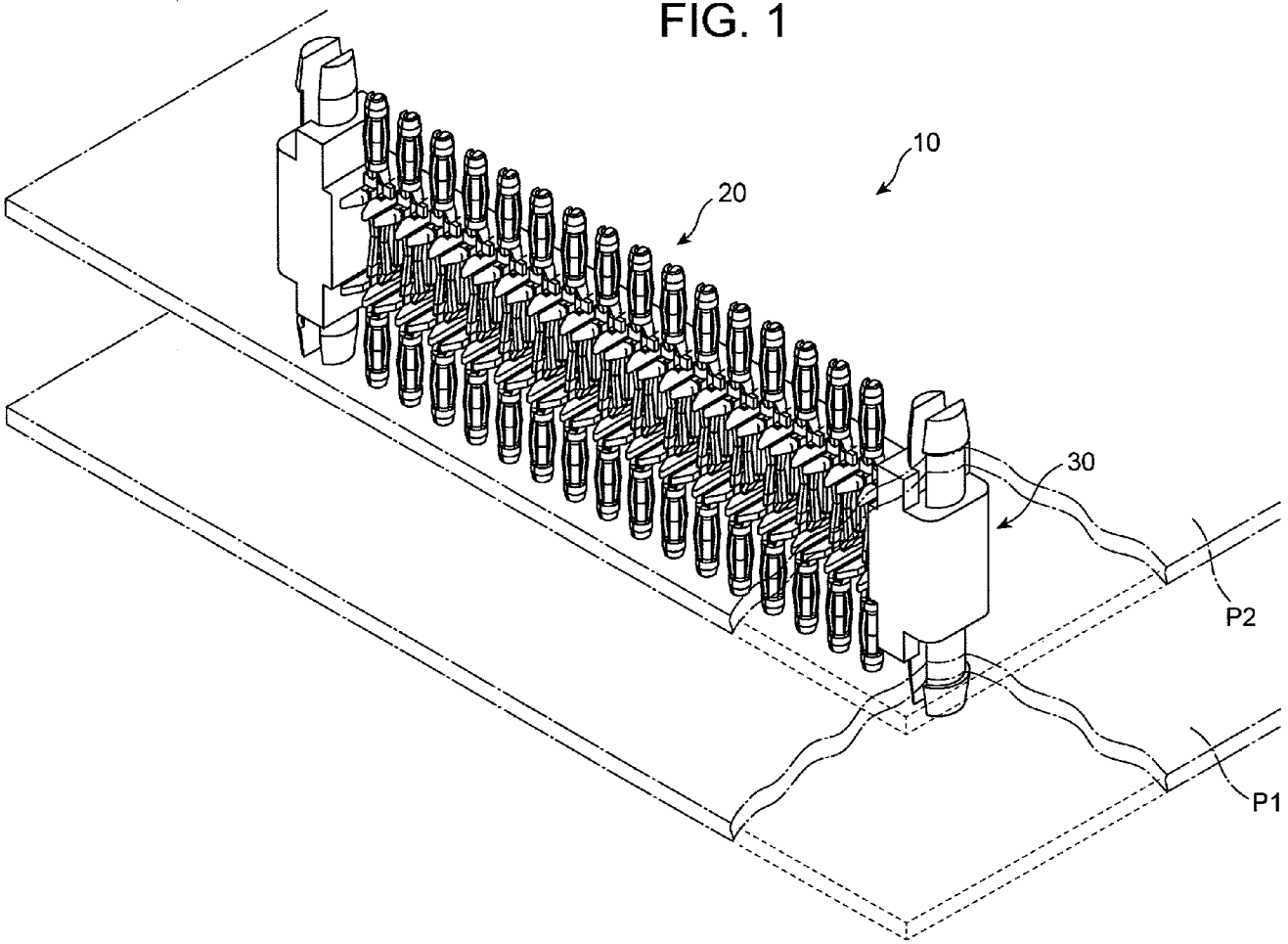
FIG. 1 is a perspective view of the electric connector in accordance with the first embodiment of the present invention, which electrically connects two printed circuit boards to each other.
Figure 2:
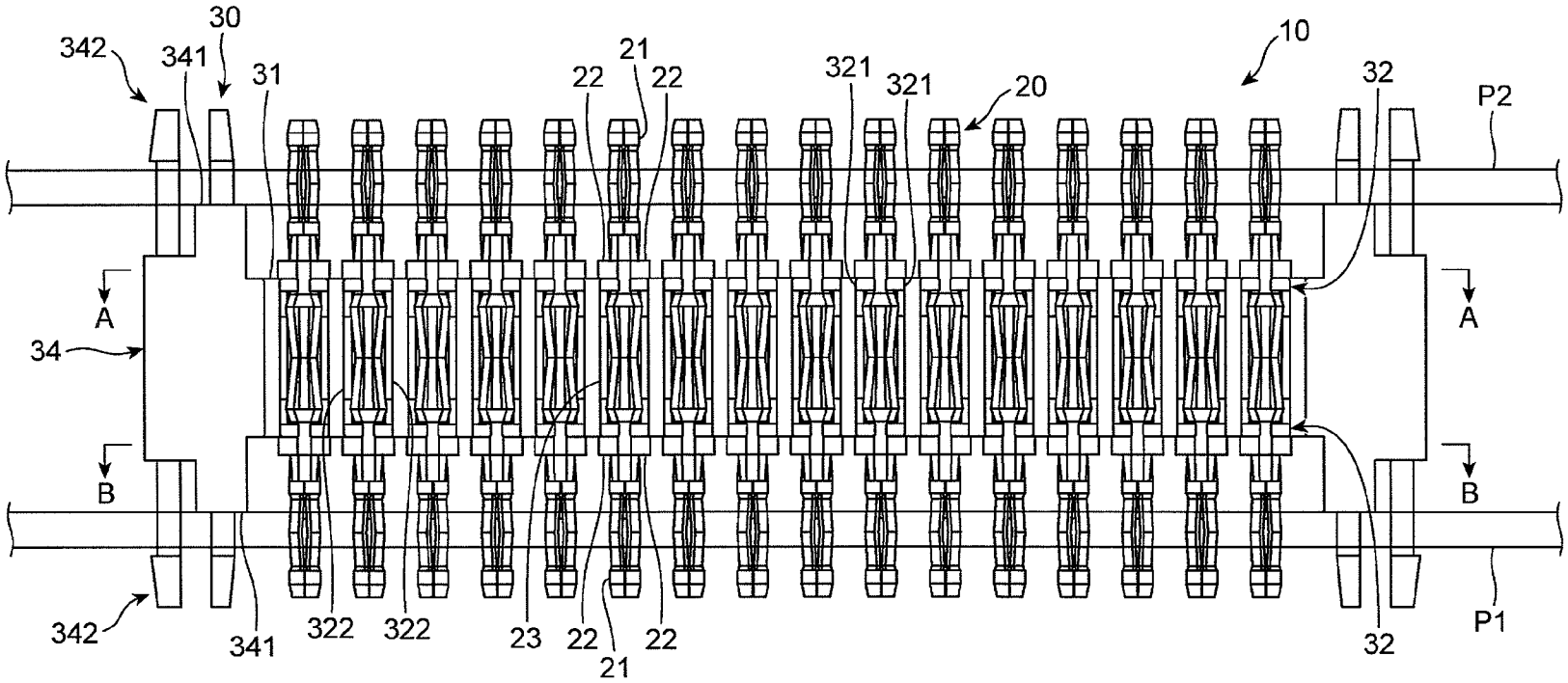
FIG. 2 is a front view of the electric connector illustrated in FIG. 1.
Figure 3:
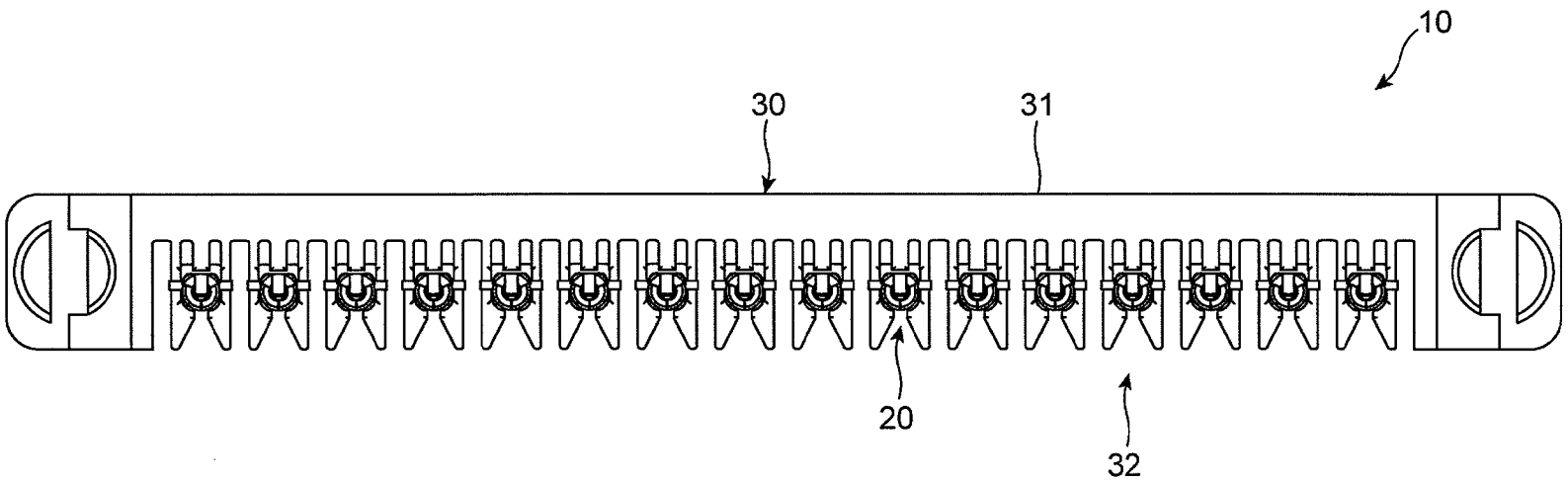
FIG. 3 is a plan view of the electric connector illustrated in FIG. 1.
Figure 4:
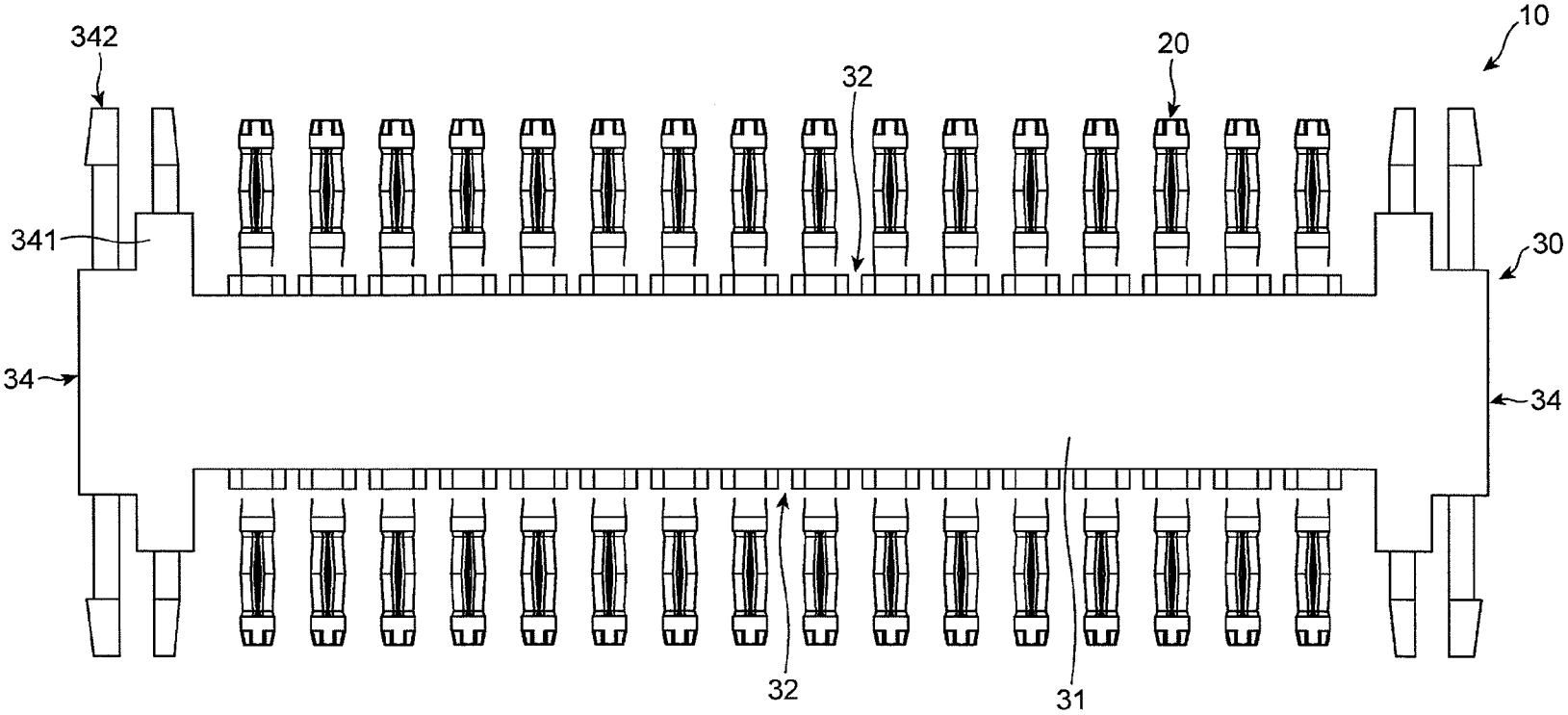
FIG. 4 is a rear view of the electric connector illustrated in FIG. 1.
Figure 5:
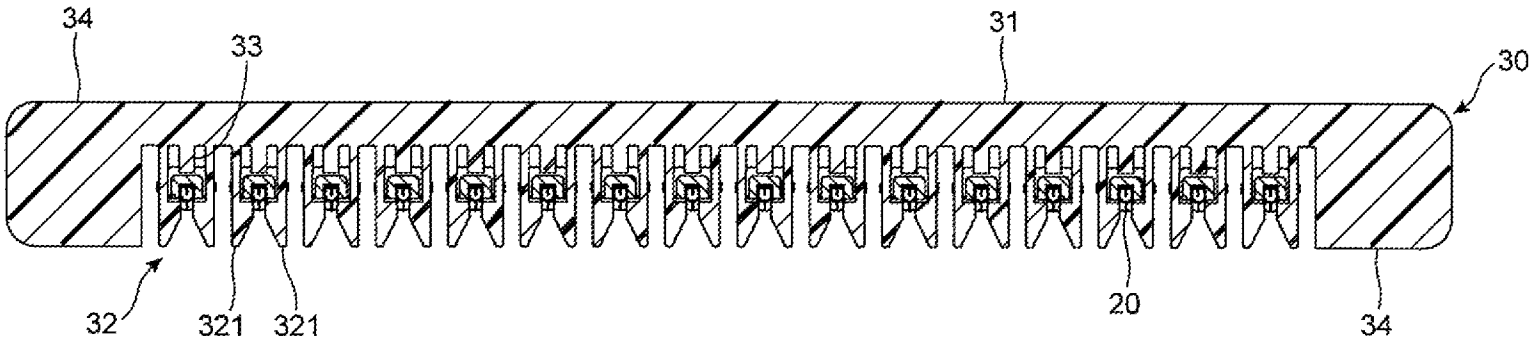
FIG. 5 is a cross-sectional view taken along the line A-A shown in FIG. 2.
Figure 6:
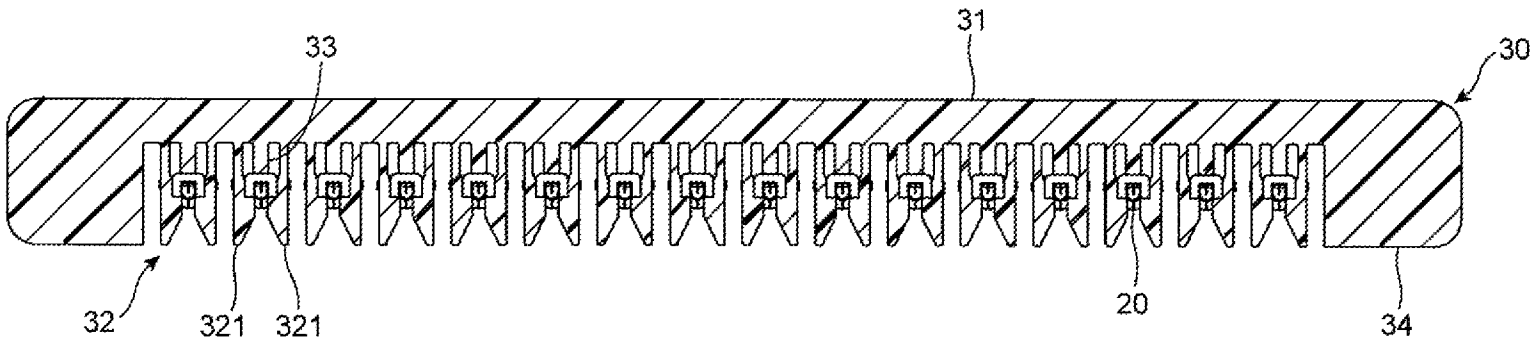
FIG. 6 is a cross-sectional view taken along the line B-B shown in FIG. 2.

The electric connector 10 illustrated in FIGS. 1 and 2 is a male connector to be mounted on an automobile for electrically connecting two printed circuit boards P1 and P2, spaced away from and facing each other, to each other.

The electric connector 10 includes a plurality of substantially bar-shaped terminal pins 20, and a base 30 supporting the terminal pins 20 aligned in a row and fixing the printed circuit boards P1 and P2.

The terminal pin 20 illustrated in FIGS. 10 to 13 includes terminals 21 formed at opposite ends and inserted into through-holes (not illustrated) formed through the printed circuit boards P1 and P2, a pair of projections 22 acting as a movement-limiter which limits movement of the terminal pin 20 in an axial direction, and a buffer zone 23 deformable in accordance with deflection between the opposite ends of the terminal pin 20. The terminal pin 20 can be formed by bending a single metal plate 210 having elasticity, illustrated in FIG. 14.

Figure 14:
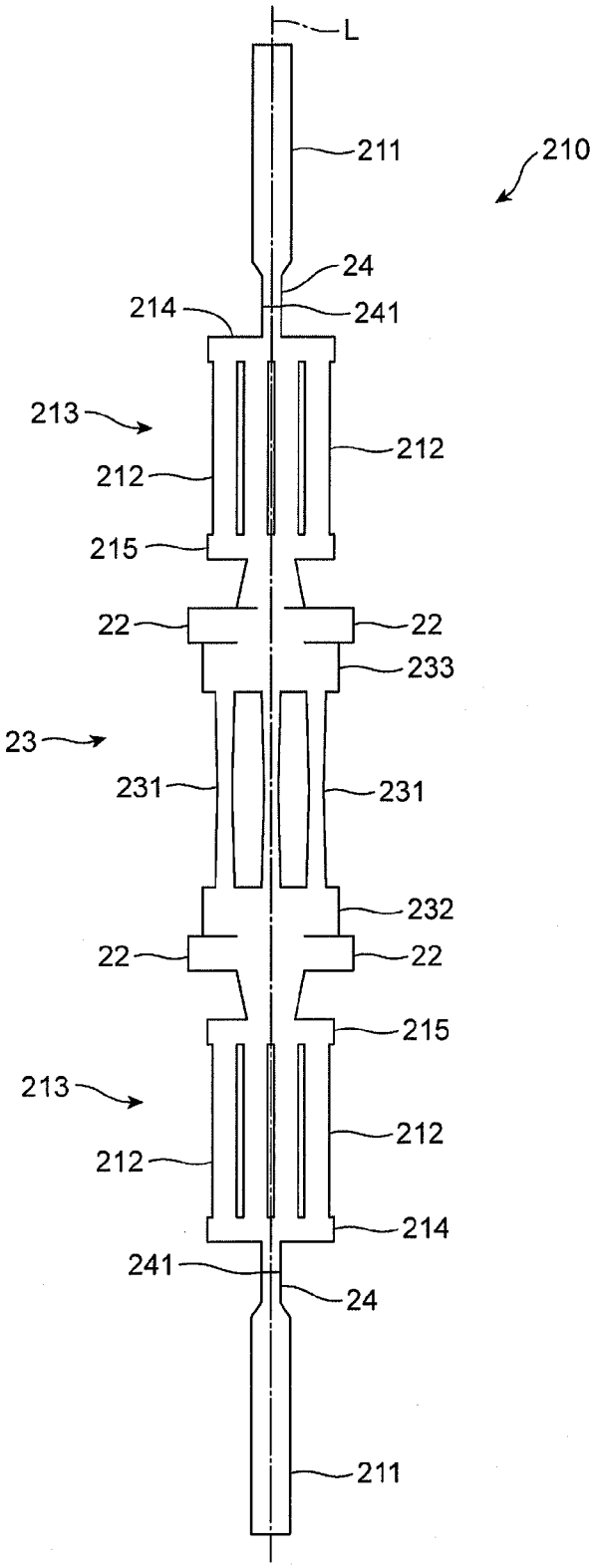
FIG. 14 is a development view of the terminal pin illustrated in FIG. 11.

Each of the terminals 21 comprises a press-fit terminal which can be connected with the printed circuit boards P1 and P2 without being soldered. As illustrated in FIG. 14, the terminal 21 includes a shaft portion 211 having a U-shaped cross-section, and a contact portion 213 including a plurality of "<"-shaped contact pieces 212 equally spaced away from adjacent ones and surrounding the shaft portion 211 such that a longitudinal direction of the contact pieces 212 extends along a longitudinal direction of the shaft portion 211 and that the contact pieces 212 outwardly projects. The contact portion 213 in the form of a barrel around the shaft portion 211 is able to elastically increase and decrease a diameter thereof. Furthermore, each of the contact pieces 212 defining the contact portion 213 includes at distal and proximal ends thereof C-shaped portions 214 and 215 surrounding the shaft portion 211.

As illustrated in FIGS. 10 to 13, each of the projections 22 is located adjacent to a proximal end of the terminal 21, and makes contact with an outer side of a later-mentioned aligner of the base 30.

The buffer zone 23 is located at a center of the terminal pin 20 between the terminals 21 formed at the opposite ends of the terminal pin 20. As illustrated in FIGS. 10 to 14, the buffer zone 23 includes a plurality of "<"-shaped resilient pieces 231 equally spaced away from adjacent ones and inwardly projecting. Each of the resilient pieces 231 defining the buffer zone 23 includes C-shaped connecting portions 232 and 233 at opposite ends thereof. The C-shaped connecting portions 232 and 233 are to be held in a later-mentioned aligner for fixing the terminal pin 20 in the aligner when the terminal pin 20 is inserted into the aligner.

Hereinbelow, a process of fabricating the terminal pin 20 is explained with reference to FIG. 14.

First, the shaft portions 211 located at opposite ends of the metal plate 210 are folded around an axial line L to define a U-shaped cross-section. Then, the U-shaped shaft portion 211 is folded by 180 degrees towards the contact portion 213 around a line 241 traversing a portion 214 located between the shaft portion 211 and the contact portion 213.

Then, the portions 214 and 215 which are marginal portions of the contact portion 213 and extend intersecting with the axial line L are bent to be C-shaped. Then, the contact pieces 212 extending in parallel to the axial line L are bent to be "<"-shaped such that the contact portion 213 is in the form of a barrel to thereby surround the shaft portion 211.

Then, the connecting portions 232 and 233 which are marginal portions of the contact portion 213 and extend intersecting with the axial line L are bent to be C-shaped. Then, the resilient pieces 231 extending in parallel to the axial line L are bent to be "<"-shaped. Thus, the terminal pin 20 illustrated in FIGS. 10 to 13 is completed.

As illustrated in FIGS. 3 to 9, the base 30 is formed substantially H-shaped by resin molding. The base 30 includes a support 31 extending in a direction in which the terminal pins 20 are aligned and having a length that can hold all of the terminal pins 20, a plurality of aligners 32 for aligning the terminal pins 20 in a row, projections 33 (see FIGS. 7 and 8) each keeping each of the terminal pins 20 inserted into the aligners 32 fixed in the aligners 32 and releasing each of the terminal pins 20 out of the aligners 32, and legs 34 for fixing the electric connector 10 to the printed circuit boards P1 and P2.

The support 31 is almost rectangular. The support 31 has a height equal to an interval between a pair of the projections 22 and another pair of the projections 22 (see FIG. 11).

Each of the aligners 32 includes an upper pair of claws 321, a lower pair of claws 321, and a pair of guide walls 322 between which the buffer zone 23 of the terminal pin 20 is supported. The electric connector 10 includes the aligners in a number equal to a number of the terminal pins 20. The aligners 32 are aligned in a row such that they are equally spaced away from adjacent ones.

Figure 7:
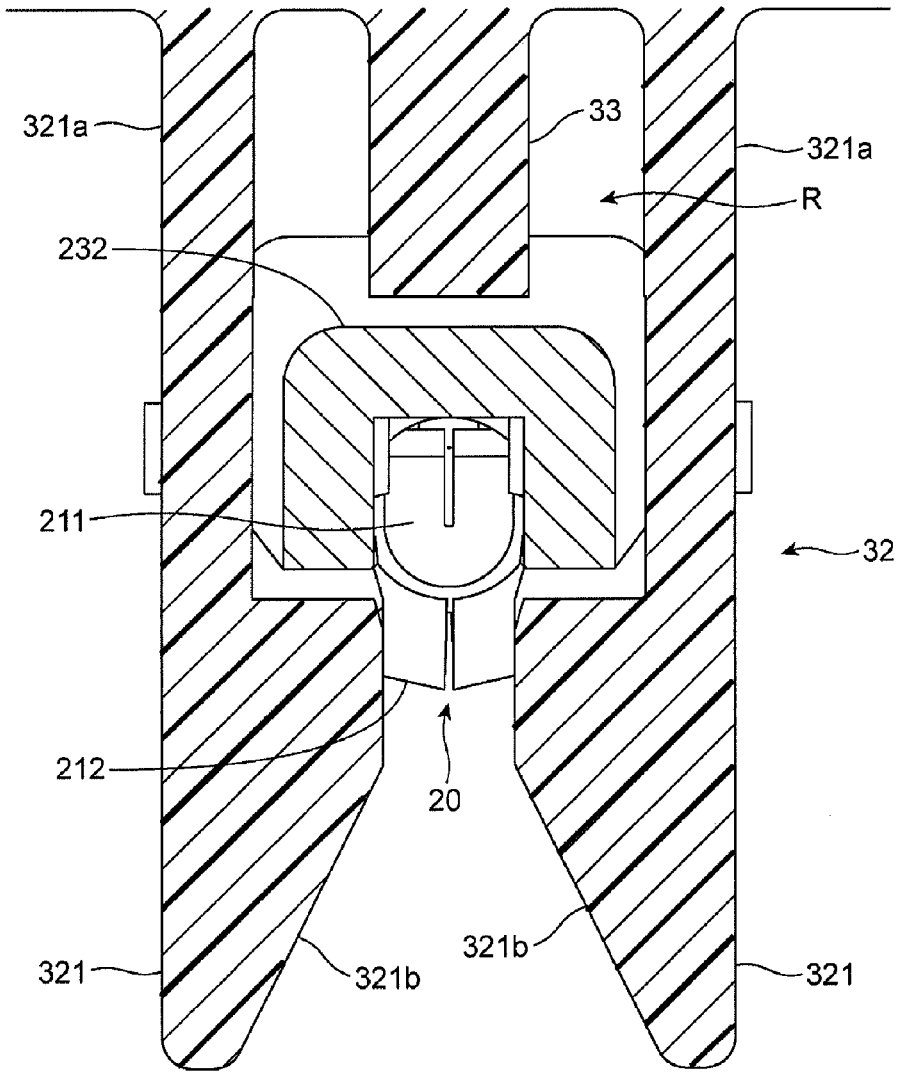
FIG. 7 is a partially enlarged view of the aligner of the electric connector illustrated in FIG. 5.
Figure 8:
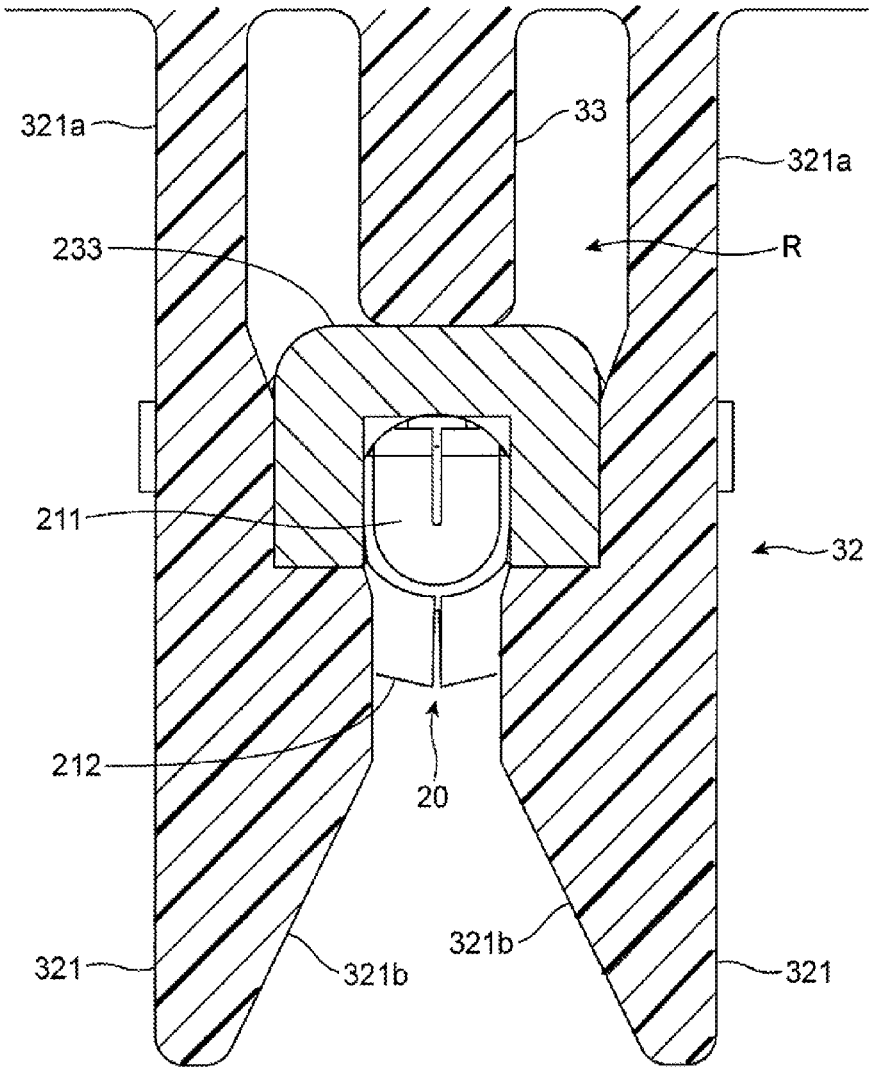
FIG. 8 is a partially enlarged view of the aligner of the electric connector illustrated in FIG. 6.

As illustrated in FIGS. 7 and 8, an upper pair of the claws 321 and a lower pair of the claws 321 each includes a pair of arms 321*a* extending from the support 31 and resiliently deformed when the terminal pin 20 is inserted into the aligner 32, and a pair of wedges 321*b* each formed at a distal end of the arm 321*a*. A space between the wedges 321*b* is smaller at a location closer to the support 31. A substantially rectangular space defined between the arms 321*a* defines a storage space R in which the terminal pin 20 is inserted.

As illustrated in FIG. 7, in the upper pair of the claws 321 located closer to the printed circuit board P2 (see FIG. 2), a gap is formed between inner walls of the arms 321*a* and the terminal pin 20.

As illustrated in FIG. 8, in the lower pair of the claws 321 located closer to the printed circuit board P1 (see FIG. 2), the arms 321*a* are designed to have raised portions such that no gap is formed between inner walls of the arms 321*a* and the terminal pin 20.

The projection 33 extends from the support 31 towards distal ends of the claws 321 between the arms 321*a*.

As illustrated in FIG. 7, even when the connecting portion 232 of the buffer zone 23 is inserted into the storage room R, there is formed a gap or gaps between the terminal pin 20 and inner walls of the wedges 321*b* extending intersecting with a direction in which the terminal pin 20 is inserted into the aligner 32, and/or between the terminal pin 20 and a head surface of the projection 33. Thus, a portion of the projection 33 located closer to the printed circuit board P2 keeps the terminal pin 20 non-fixed.

As illustrated in FIG. 8, when the connecting portion 233 of the buffer zone 23 is inserted into the storage room R, the terminal pin 20 is sandwiched between the head surface of the projection 33 and the inner walls of the wedges 321*b* extending intersecting with a direction in which the terminal pin 20 is inserted into the aligner 32. Thus, a portion of the projection 33 located closer to the printed circuit board P1 keeps the terminal pin 20 fixed.

Figure 9:
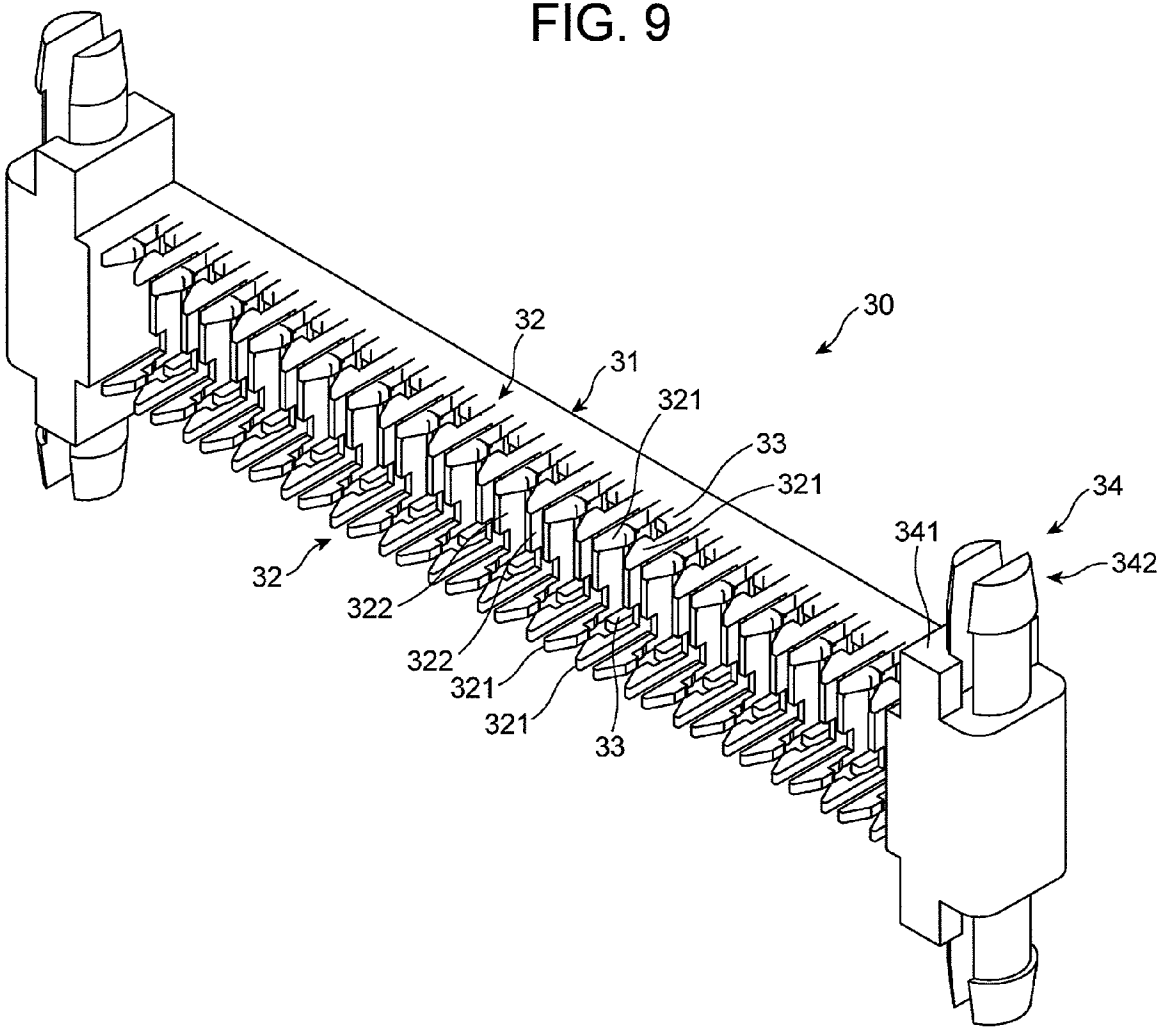
FIG. 9 is a perspective view of the base of the electric connector illustrated in FIG. 1.
Figure 10:
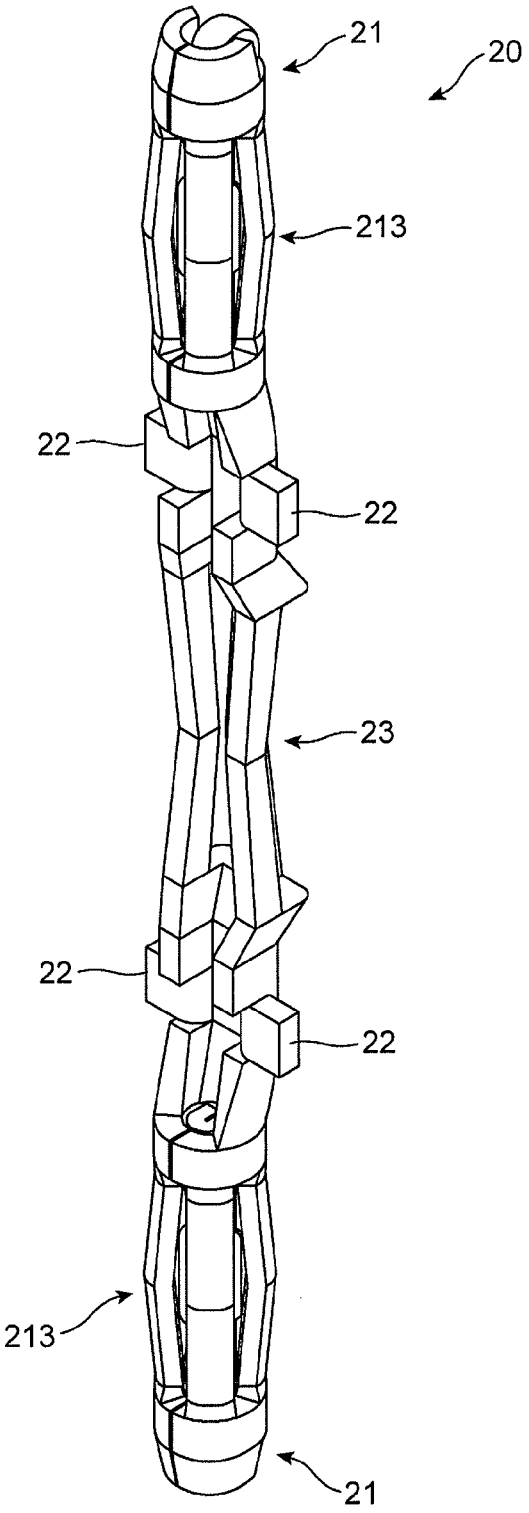
FIG. 10 is a perspective view of the terminal pin of the electric connector illustrated in FIG. 1.
Figure 11:
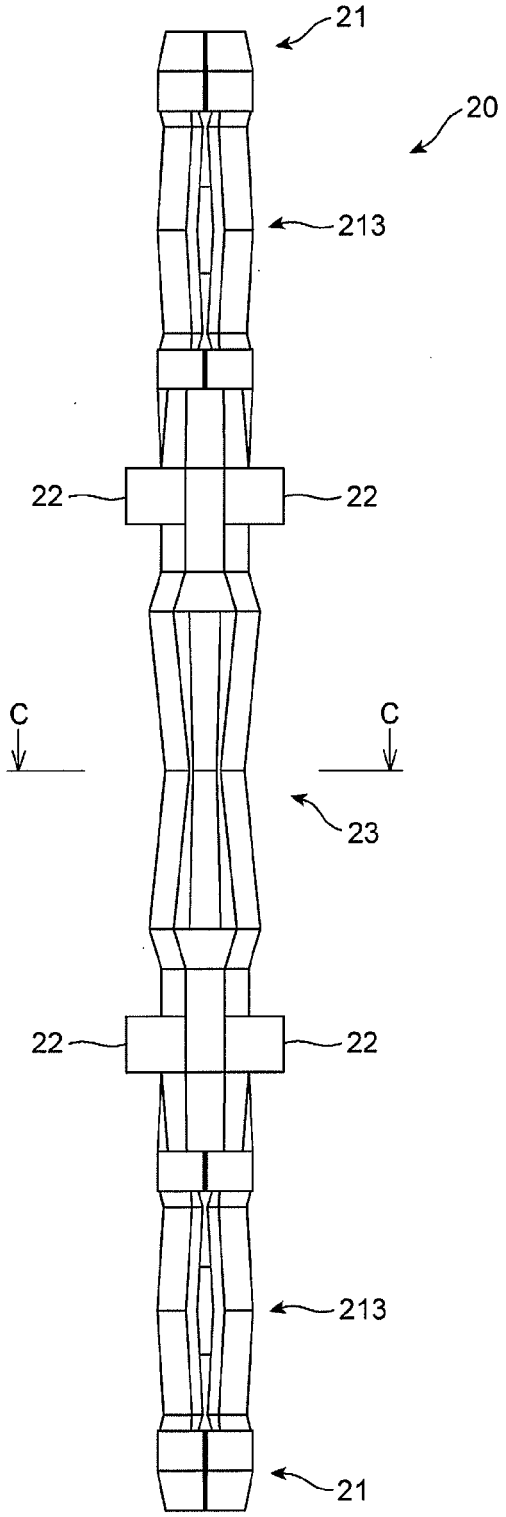
FIG. 11 is a front view of the terminal pin illustrated in FIG. 10.
Figure 12:
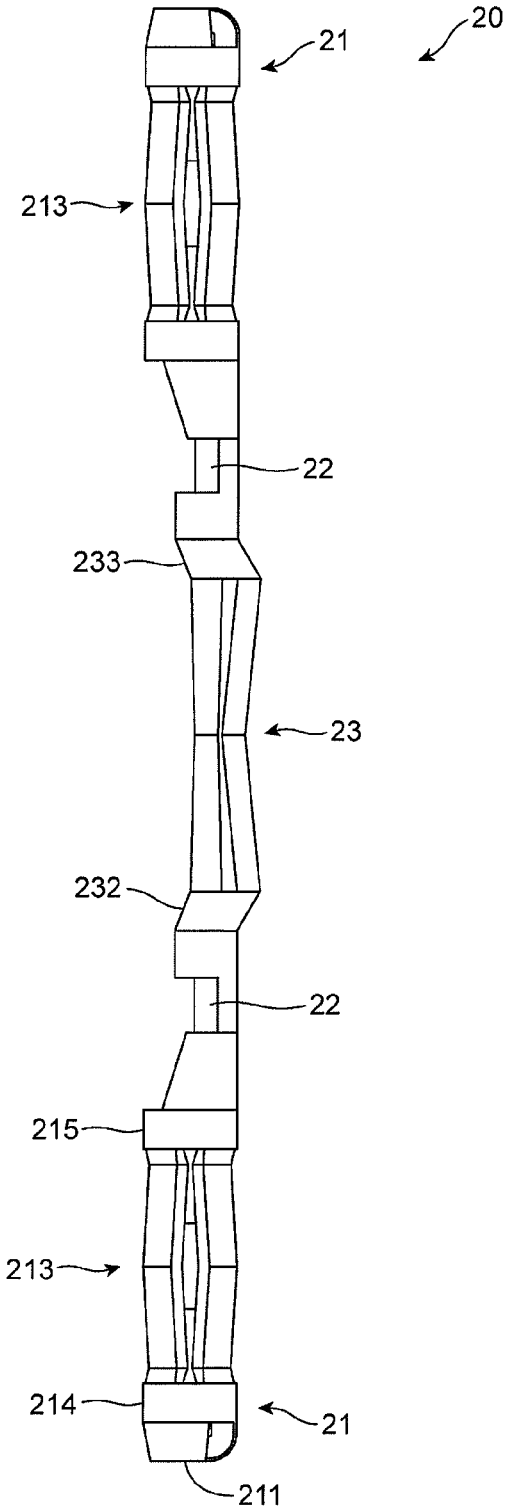
FIG. 12 is a side view of the terminal pin illustrated in FIG. 10.
Figure 13:
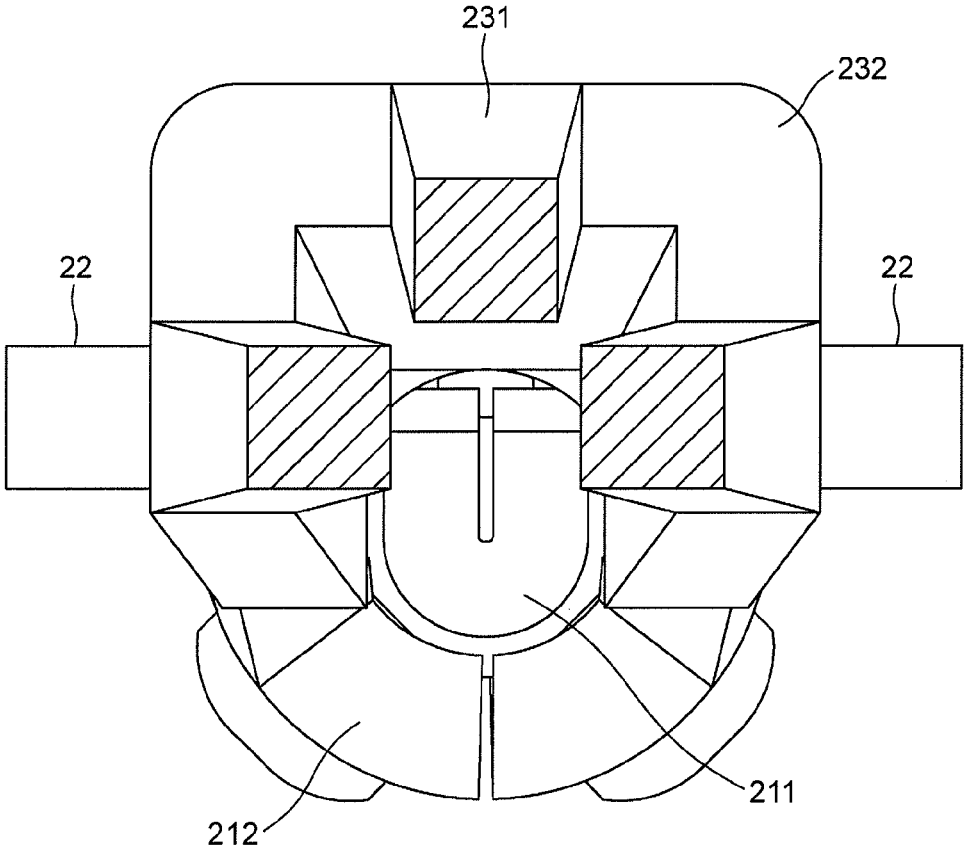
FIG. 13 is a cross-sectional view taken along the line C-C shown in FIG. 11.

As illustrated in FIG. 9, the legs 34 are formed at opposite ends of the support 31. The legs 34 are inserted into through-holes (not illustrated) formed through the printed circuit boards P1 and P2 to thereby keep the printed circuit boards P1 and P2 spaced away from each other and fix the base 30 between the printed circuit boards P1 and P2. Furthermore, the legs 34 have a function of reinforcing the terminal pins 20. The leg 34 includes a contact portion 341 and fit portions 342. The contact portion 341 includes projecting blocks. Top surfaces of the projecting blocks make contact with surfaces of the printed circuit boards P1 and P2, thereby the printed circuit boards P1 and P2 being kept spaced away from each other. The fit portions 342 project at opposite ends of the contact portion 341 in an axial direction.

Each of the fit portions 342 includes a pair of semi-circular pillars to define a cylindrical pillar. When the fit portions 342 are inserted into the printed circuit boards P1 and P2, wedges formed at a head of the fit portions 342 make engagement with peripheral edges of through-holes of the printed circuit boards P1 and P2.

How to use the electric connector 10 in accordance with the first embodiment, having the above-mentioned structure, is explained hereinbelow with reference to the drawings.

First, as illustrated in FIG. 2, one of the fit portions 342 is inserted into the through-hole of the printed circuit board P1, and the terminals 21 formed at one of the opposite ends of the terminal pins 20 are inserted into the through-holes formed in a row through the printed circuit board P1.

Since each of the terminals 21 is formed by bending the contact pieces 212 such that the contact pieces 212 surround the shaft portion 211 illustrated in FIG. 14, and is reinforced by the U-shaped shaft portion 211 acting as a core, the terminals 21 can be inserted into the printed circuit board P1 without axes of the terminals 21 illustrated in FIG. 1 being bent. Furthermore, since the terminals 21 can make close contact with inner surfaces of the through-holes of the printed circuit board P1 without being soldered, by virtue of the reaction force of the contact pieces 212 having been resiliently deformed, the terminal pins 20 can surely make electrical contact with the printed circuit board P1.

In addition, even if a force acts axially on the terminal pin 20 in order to insert the terminal 21 into the through-holes of the printed circuit board P1, since the projections 22 located closer to the printed circuit board P1 make engagement with the claws 321, the terminal pin 20 is restricted in the movement in an axial direction. Accordingly, the terminal pin 20 is not allowed to axially move, the terminal 21 located closer to the printed circuit board P1 can be inserted into the through-hole of the printed circuit board P1.

Then, keeping the printed circuit board P2 above the electric connector 10, the other fit portion 342 is inserted into the through-holes of the printed circuit board P2, and the terminals 21 formed at the other opposite ends of the terminal pins 20 are inserted into the through-holes formed in a row through the printed circuit board P2.

Even if a positional relation between the printed circuit boards P1 and P2 were deflected and accordingly positions of the through-holes of the printed circuit board P2 were deflected from positions of the through-holes of the printed circuit board P1, since the terminal pins 20 are held in a non-fixed condition in the storage rooms R of the aligners 32 located closer to the printed circuit board P2, the terminals 21 can be deflected towards the through-holes, and hence, the terminals 21 can be inserted into the through-holes.

If the terminal pins 20 illustrated in FIG. 2 were inserted into the printed circuit boards P1 and P2 with a positional relation between the printed circuit boards P1 and P2 being deflected, an axis of the terminal pin 20 would be bent. However, the resilient pieces 231 (see FIG. 14) of the buffer zone 23 are deformed in dependence on the deflection in an axis extending between one of the terminals 21 located closer to the printed circuit board P1 and the other terminal 21 located closer to the printed circuit board P2, and therefore an excessive force would not be exerted on the terminal 21. Since the buffer zone 23 comprises a plurality of the resilient pieces 231, the buffer zone 23 is able to be deformed in accordance with a direction in which the axis of the terminal pin 20 deflects, and further, the terminal pin 20 can electrically connect the printed circuit boards P1 and P2 to each other, even if large amount of current is to run across the printed circuit boards P1 and P2.

Figure 15:
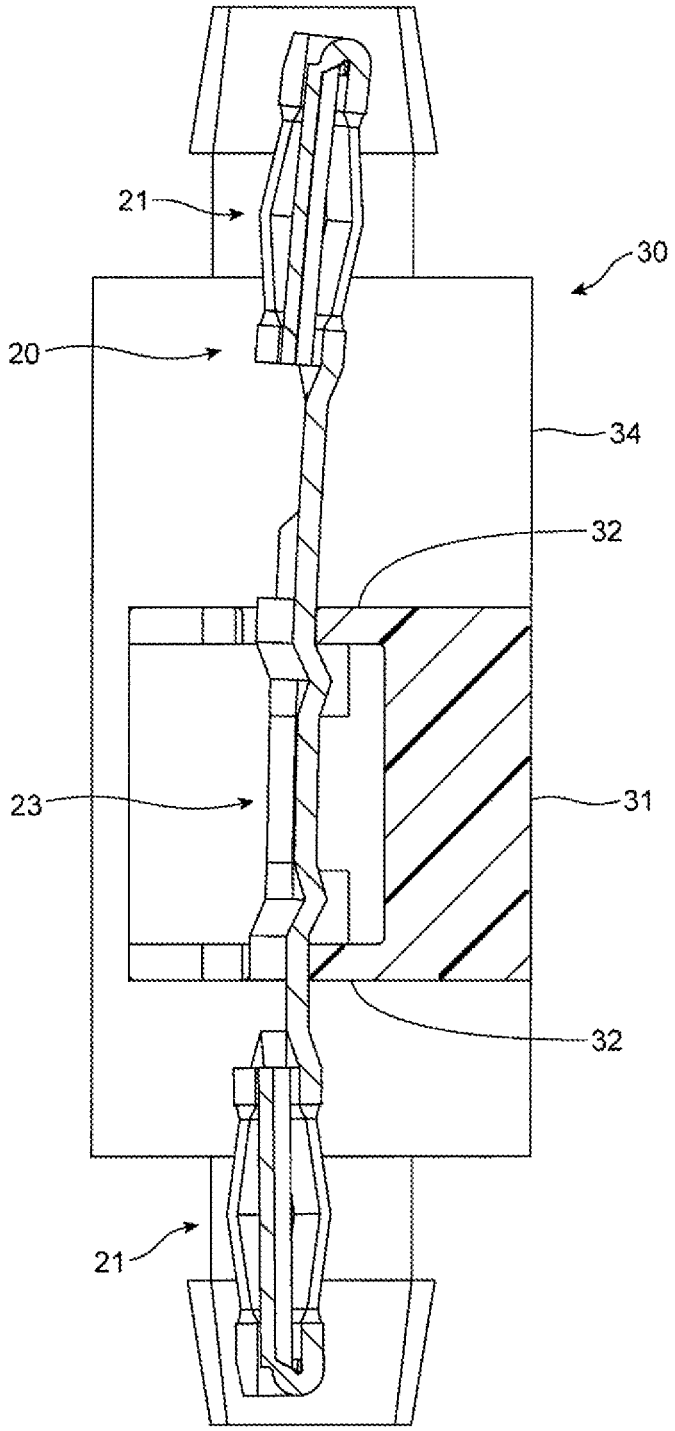
FIG. 15 is a vertical cross-sectional view of the terminal pin, viewed from the side, showing that an axis of the terminal pin deflects backwardly.
Figure 16:
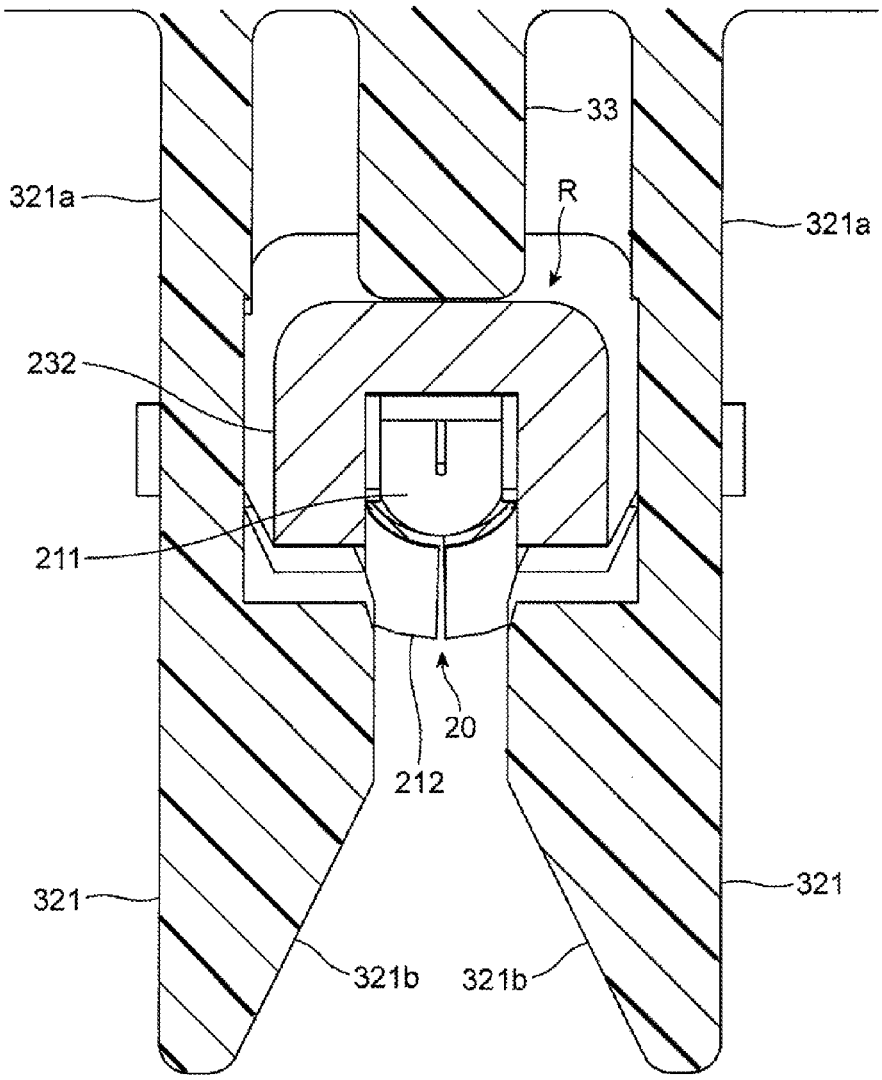
FIG. 16 is a horizontal cross-sectional view of the terminal pin located in the aligner, showing that an axis of the terminal pin deflects backwardly.

For instance, even if the through-holes of the printed circuit board P2 into which the terminal 21 is inserted were deflected towards the support 31 (namely, towards the rear) relative to the through-holes of the printed circuit board P1, as illustrated in FIGS. 15 and 16, the terminal pin 20 can be deformed in the storage room R located closer to the printed circuit board P2 within such a range that the terminal pin 20 makes contact with the projection 33 acting as a rear wall of the storage room R, and hence, the terminal pin 20 can be deformed towards the rear.

Figure 17:
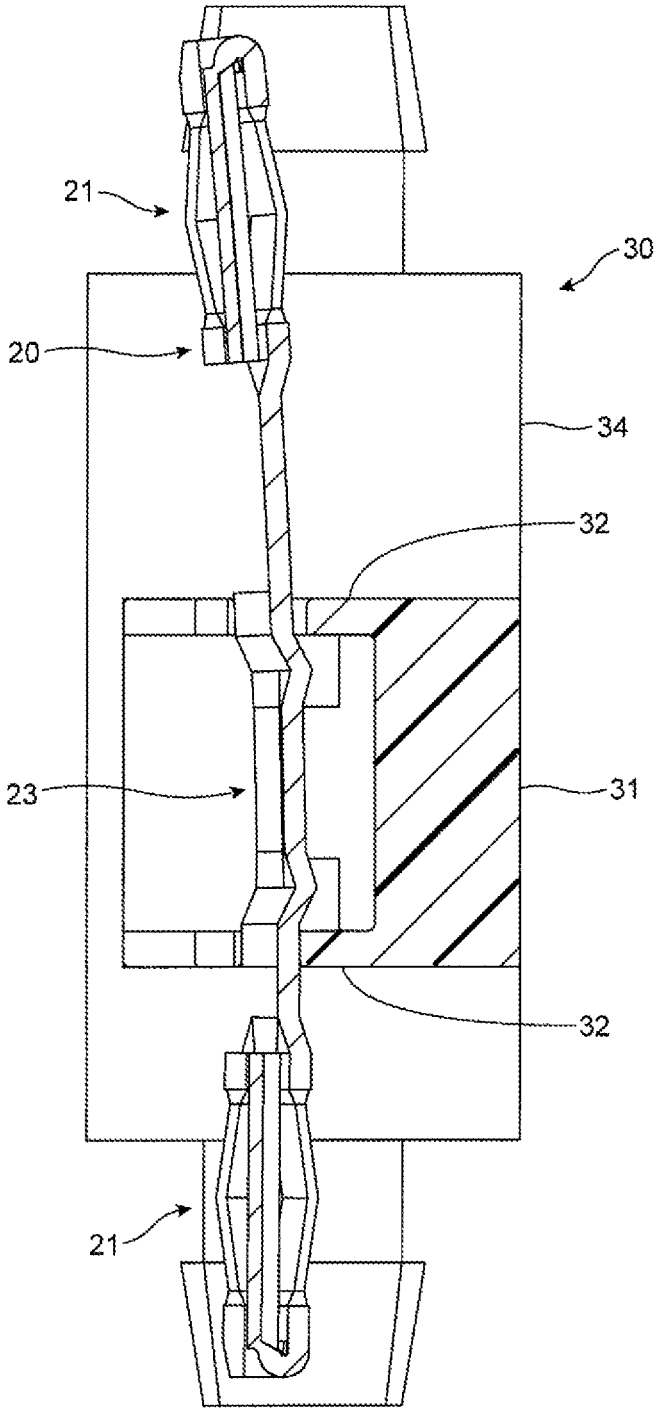
FIG. 17 is a vertical cross-sectional view of the terminal pin, viewed from the side, showing that an axis of the terminal pin deflects frontwardly.
Figure 18:
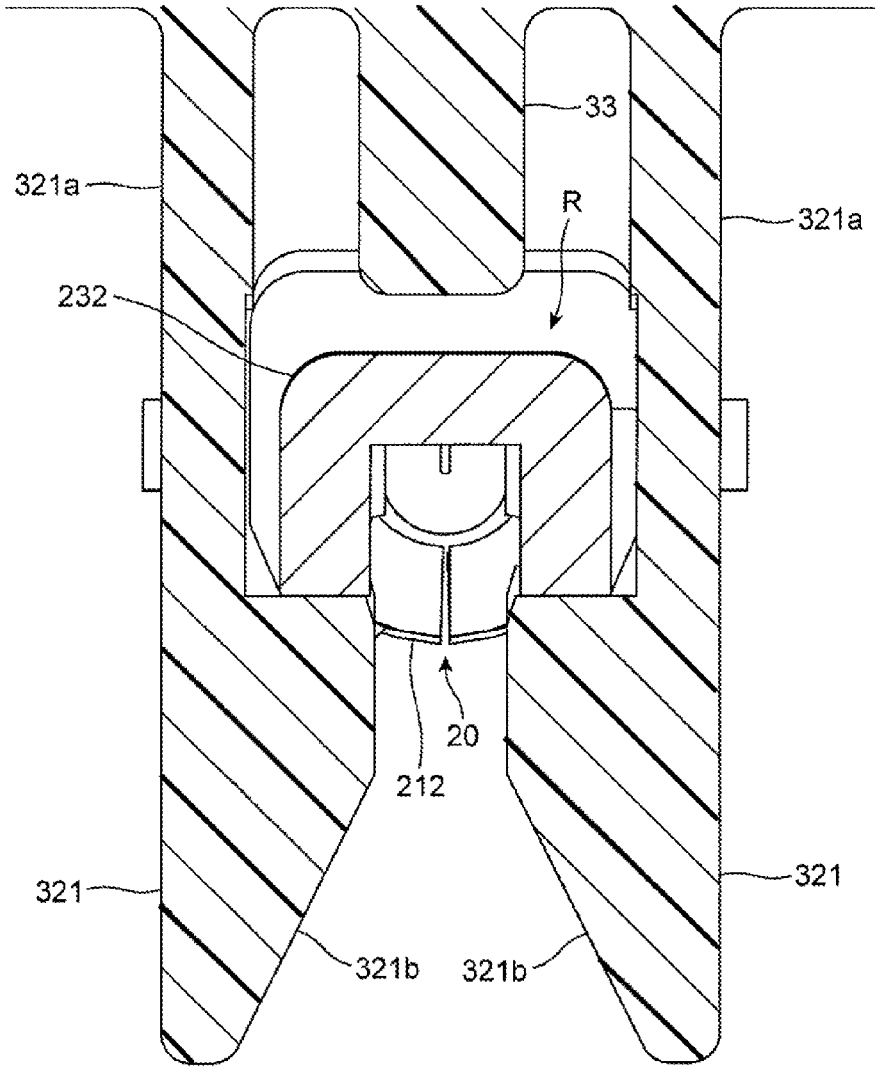
FIG. 18 is a horizontal cross-sectional view of the terminal pin located in the aligner, showing that an axis of the terminal pin deflects frontwardly.

On the contrary, even if the through-holes of the printed circuit board P2 were deflected away from the support 31 (namely, towards the front) relative to the through-holes of the printed circuit board P1, as illustrated in FIGS. 17 and 18, the terminal pin 20 can be deformed in the storage room R within such a range that the terminal pin 20 makes contact with the wedges 321*b* acting as a front wall of the storage room R, and hence, the terminal pin 20 can be deformed towards the front.

Figure 19:
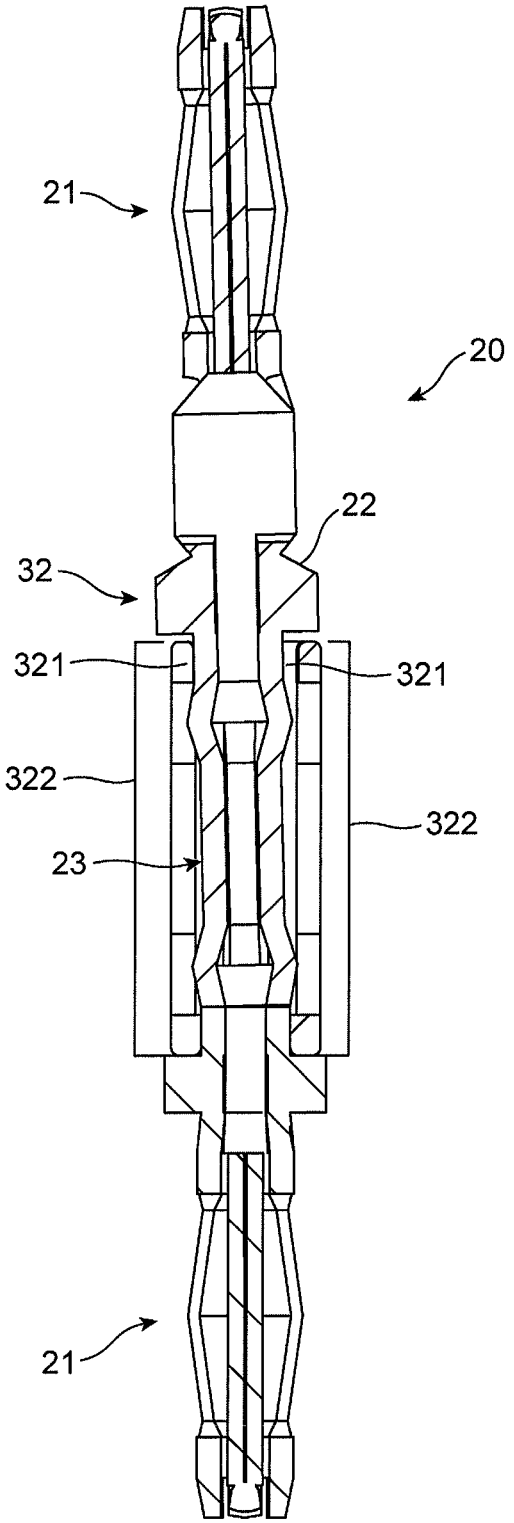
FIG. 19 is a vertical cross-sectional view of the terminal pin, viewed from the front, showing that an axis of the terminal pin deflects to the left.
Figure 20:
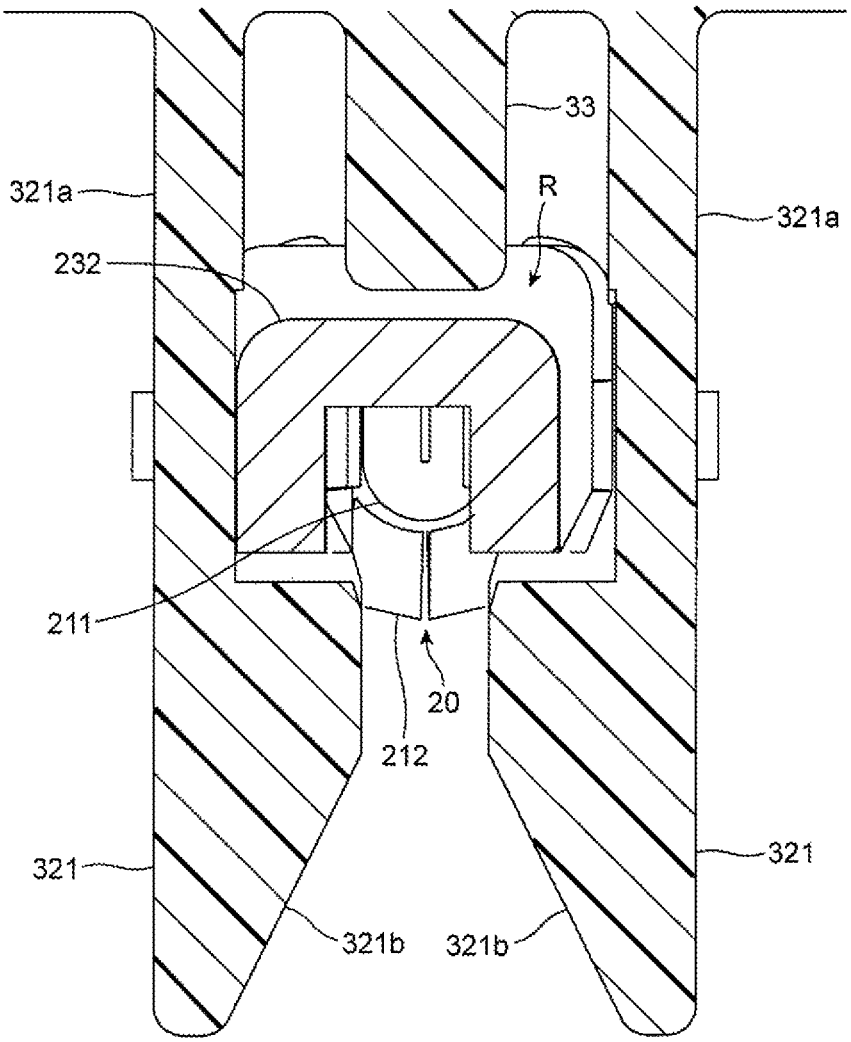
FIG. 20 is a horizontal cross-sectional view of the terminal pin located in the aligner, showing that an axis of the terminal pin deflects to the left.

Even if the through-holes of the printed circuit board P2 were deflected to a direction intersecting with the front-rear direction (for instance, to the left) relative to the through-holes of the printed circuit board P1, as illustrated in FIGS. 19 and 20, the terminal pin 20 can be deformed in the storage room R within such a range that the terminal pin 20 makes contact with an inner wall of one of the wedges 321*a*, acting as a left wall of the storage room R, and hence, the terminal pin 20 can be deformed to the left.

Figure 21:
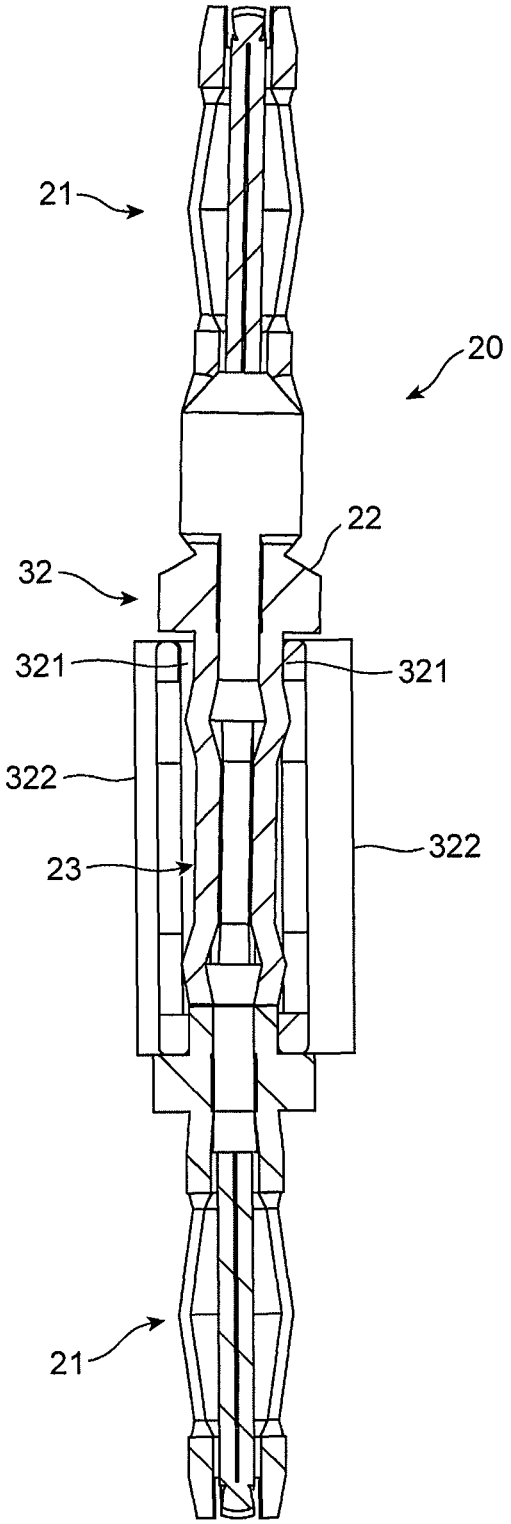
FIG. 21 is a vertical cross-sectional view of the terminal pin, viewed from the front, showing that an axis of the terminal pin deflects to the right.
Figure 22:
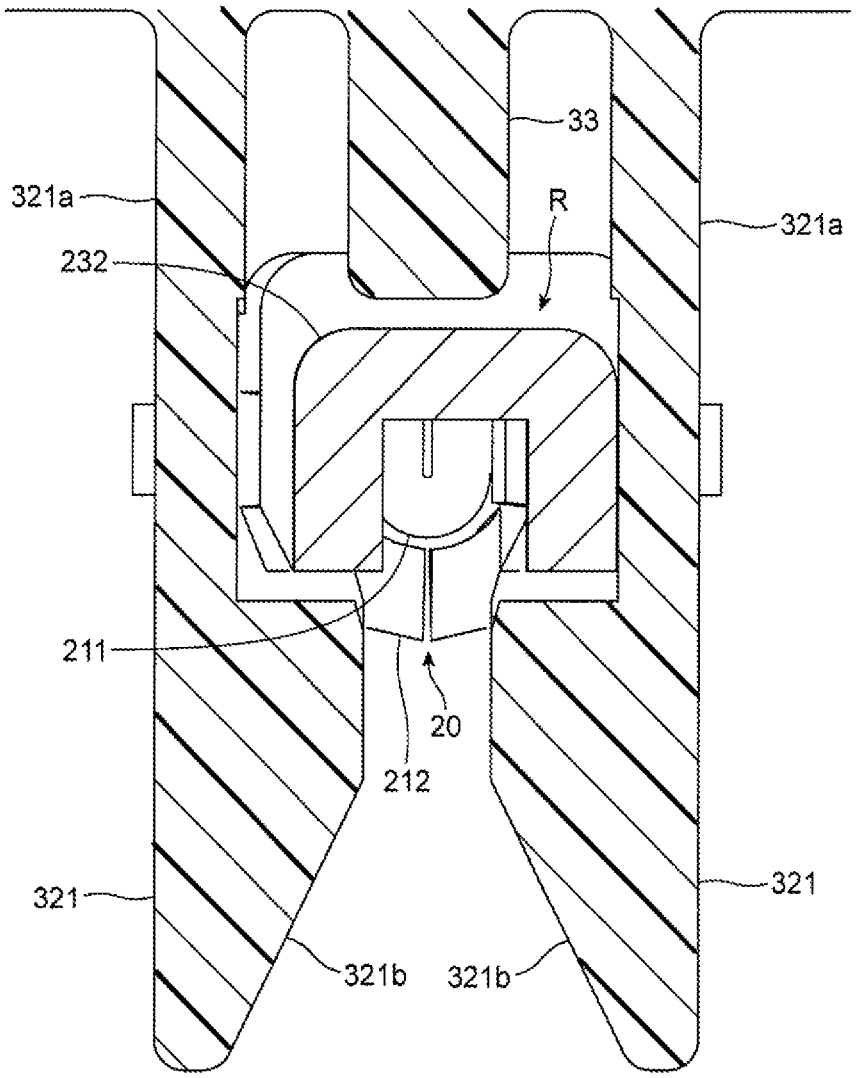
FIG. 22 is a horizontal cross-sectional view of the terminal pin located in the aligner, showing that an axis of the terminal pin deflects to the right.

Even if the through-holes of the printed circuit board P2 were deflected to a direction intersecting with the front-rear direction (for instance, to the right) relative to the through-holes of the printed circuit board P1, as illustrated in FIGS. 21 and 22, the terminal pin 20 can be deformed in the storage room R within such a range that the terminal pin 20 makes contact with an inner wall of the other wedge 321*a*, acting as a right wall of the storage room R, and hence, the terminal pin 20 can be deformed to the right.

As mentioned above, even if a positional relation between the printed circuit boards P1 and P2 were deflected to the front, rear, left or right, the terminal pins 20 could absorb the deflection and be inserted into the printed circuit boards P1 and P2.

In addition, even if a force acts axially on the terminal pin 20 in order to insert the terminal 21 into the through-holes of the printed circuit board P2, since the projections 22 located closer to the printed circuit board P2 make engagement with the claws 321, the terminal pin 20 is restricted in the movement in an axial direction. Accordingly, even if the terminal pin 20 is not fixed in the storage room R closer to the printed circuit board P2, the terminal pin 20 is not allowed to axially move, and hence, the terminal 21 can be inserted into the through-hole of the printed circuit board P2.

Thus, the other terminal 21 can be inserted into the printed circuit board P2 without problems with the opposite terminal 21 being inserted into the printed circuit board P1.

In particular, when each of the printed circuit boards P1 and P2 is formed with a plurality of rows of through-holes in parallel and the printed circuit boards P1 and P2 are electrically connected to each other through the through-holes by a plurality of the electric connectors 10, if there were deflection in a space between the through-hole rows and/or a space between the adjacent through-holes, a total of such deflection would be quite large. Even in such a case, since the terminal pin 20 is held in a non-fixed condition in the storage room R located closer to the printed circuit board P2 and the terminal pin 20 includes the buffer zone 23, even if directions of terminals 21 were not common in each of the terminal pins 20, the terminals 21 could be deformed towards the direction in which the terminals 21 are deflected. Thus, the terminal pins 20 can be inserted into both the printed circuit boards P1 and P2 without problems.

As mentioned above, since the terminals 21 of the electric connector 10 can be surely inserted into the printed circuit boards P1 and P2, the connectability between the printed circuit boards P1 and P2 can be enhanced.

The buffer zone 23 is located between the upper and lower pairs of the claws 321, and the terminal pin 20 is inserted into a space formed between a pair of the claws 321 and is further inserted in a direction intersecting with an axis of the terminal pin 20 with the claws 321 being deformed, thereby the terminal pin 20 being guided into the storage room R, and hence, the terminal pin 20 can be set in the aligner 32 after the base 30 has been fabricated. Thus, it is not necessary, when the base 30 is molded, to set the terminal pin 20 in a mold.

Since the terminal pin 20 can be in a fixed or non-fixed condition in the storage room R in dependence on a length of the projection 33 and a space between the arms 321*a*, and further since a range in which the terminal pin 20 is able to swing when the terminal pin 20 is in a non-fixed condition can be in dependence on the same, it is possible to readily arrange a position of the terminal 21.

A printed circuit board to be used for an electronic device equipped in an automobile thermally expands or contracts due to an atmospheric temperature change in the range of minus 20 to 80 degrees centigrade. In a case that an electric connector is soldered to a printed circuit board, a high stress acts on the solder due to expansion and contraction of a printed circuit board. Since such a high stress repeatedly acts on the solder, the solder is cracked, resulting in deterioration in electrical connection between the printed circuit boards P1 and P2. However, since the electric connector 10 in accordance with the first embodiment includes the terminals 21 each comprising a press-fit terminal, the printed circuit boards P1 and P2 can be electrically connected to each other merely by inserting the terminals 21 into the printed circuit boards P1 and P2 without soldering the terminals 21 onto the printed circuit boards P1 and P2. Thus, it is possible to avoid deterioration in electrical connection between the printed circuit boards P1 and P2, caused by expansion and contraction of the printed circuit boards P1 and P2.

Second Embodiment

The electric connector in accordance with the second embodiment is explained hereinbelow with reference to FIGS. 23 to 26. Parts or elements in FIGS. 23 to 26 that correspond to those illustrated in FIGS. 10 to 14 have been provided with the same reference numerals, and are not explained.

A terminal pin 20X to be used in the electric connector in accordance with the second embodiment is characterized in that a buffer zone 23X includes a width-reduced portion.

Figure 23:
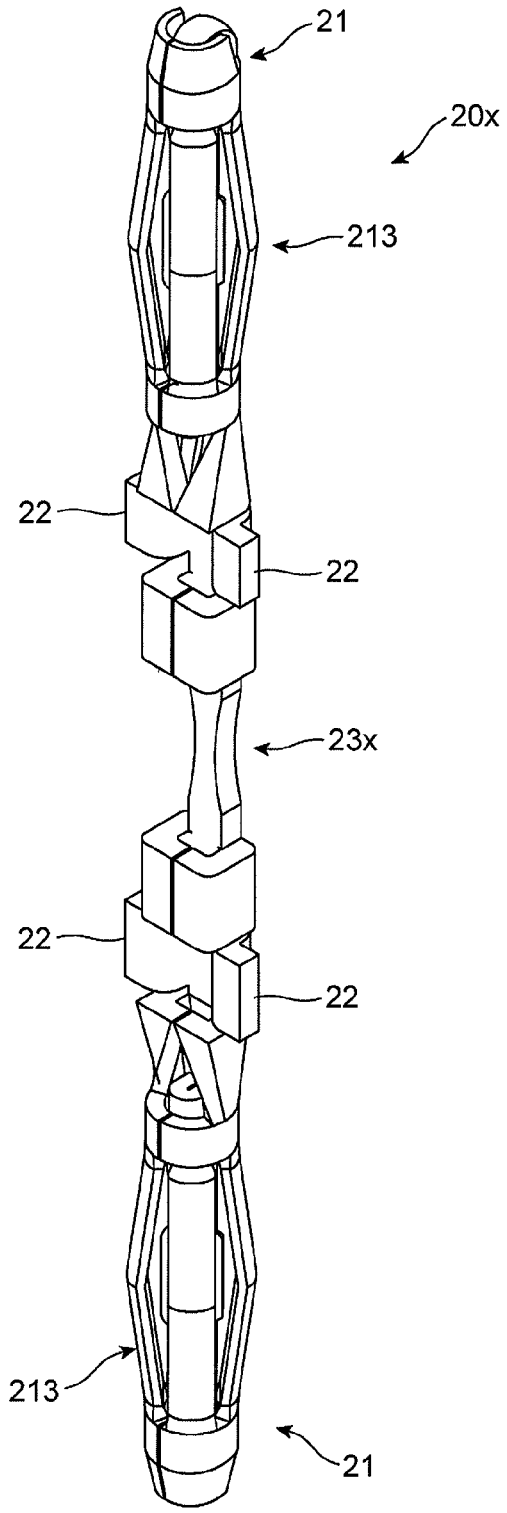
FIG. 23 is a perspective view of the terminal pin in accordance with the second embodiment of the present invention.
Figure 24:
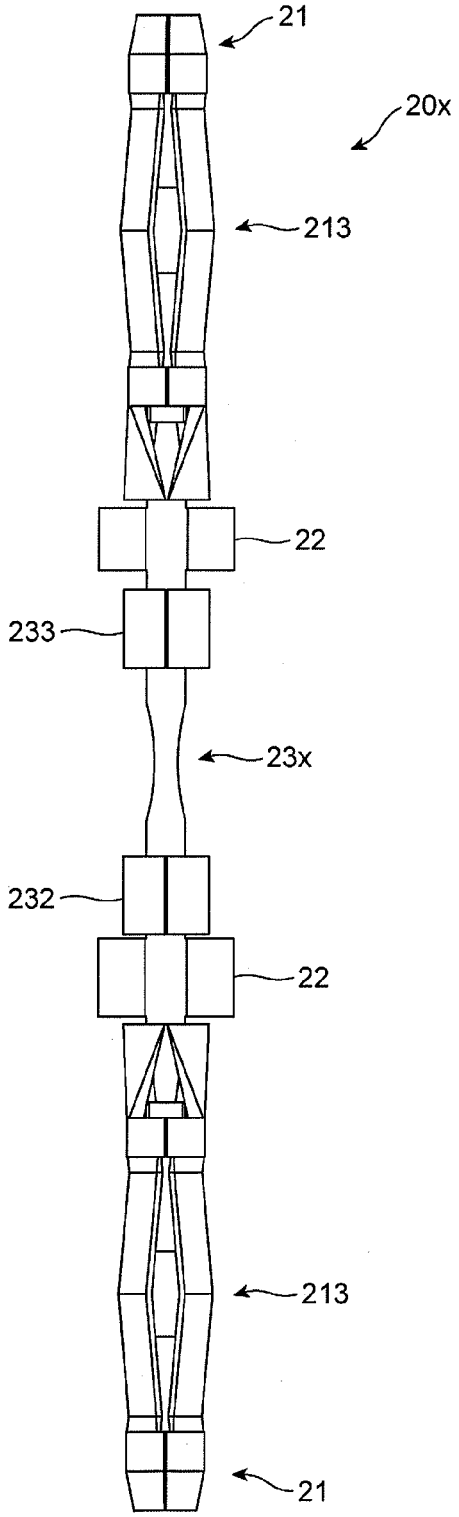
FIG. 24 is a front view of the electric connector illustrated in FIG. 23.
Figure 25:
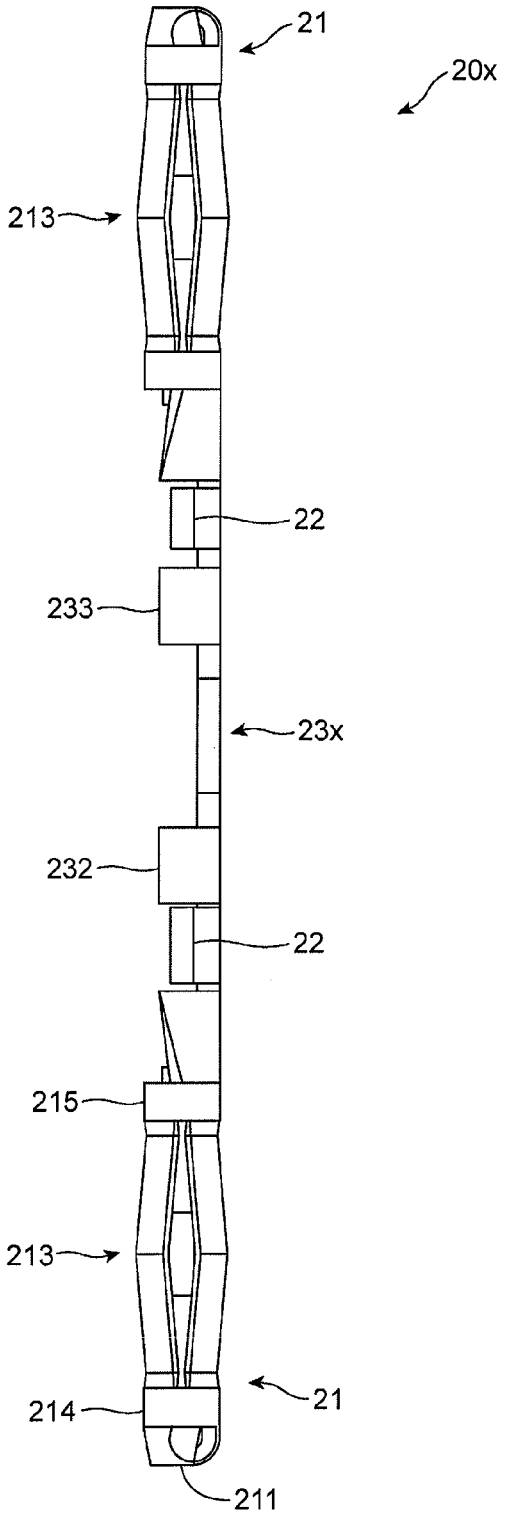
FIG. 25 is a side view of the electric connector illustrated in FIG. 23.
Figure 26:
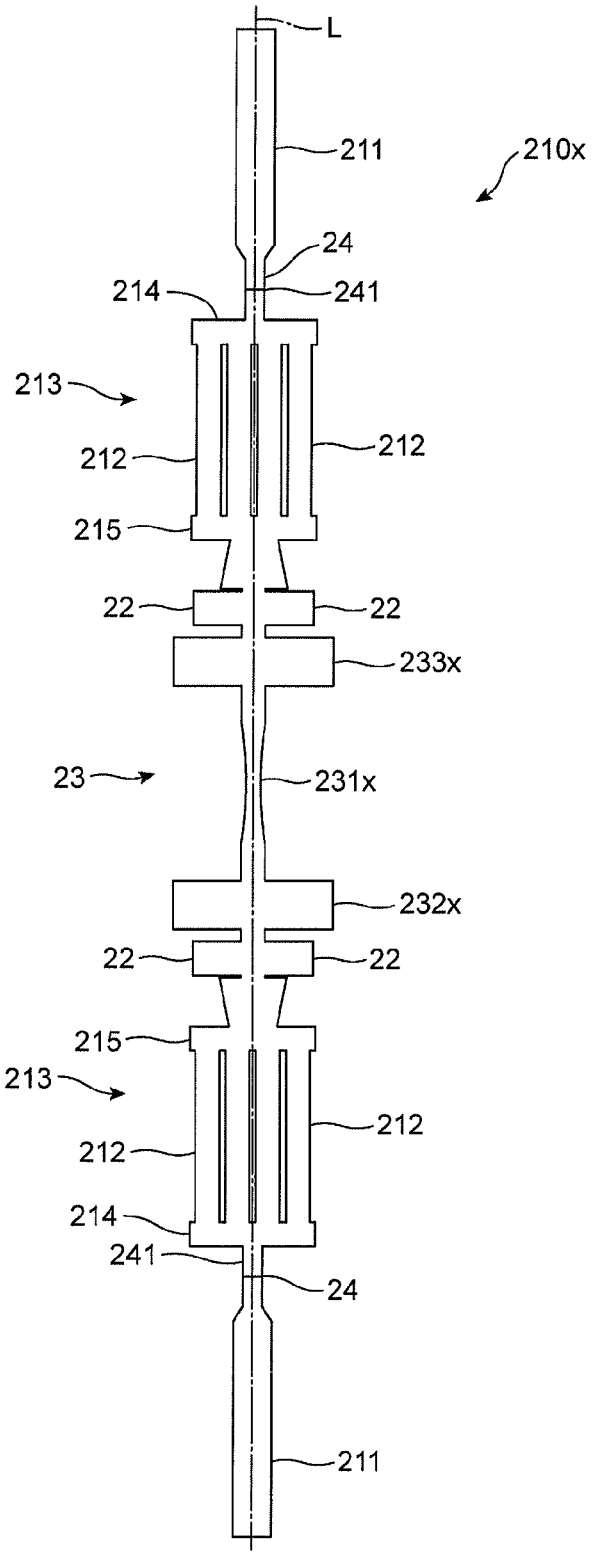
FIG. 26 is a development view of the terminal pin illustrated in FIG. 23.
Figure 27:
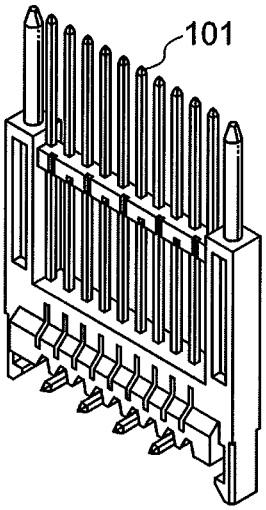
FIG. 27 is a perspective view of the conventional connector.
Figure 28:
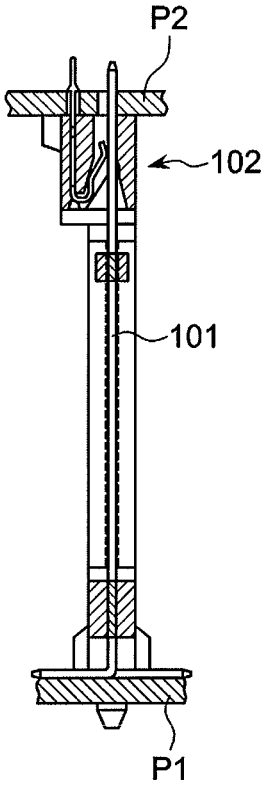
FIG. 28 is a cross-sectional view of the conventional connector illustrated in FIG. 27, sandwiched between two printed circuit boards.
Figure 29:
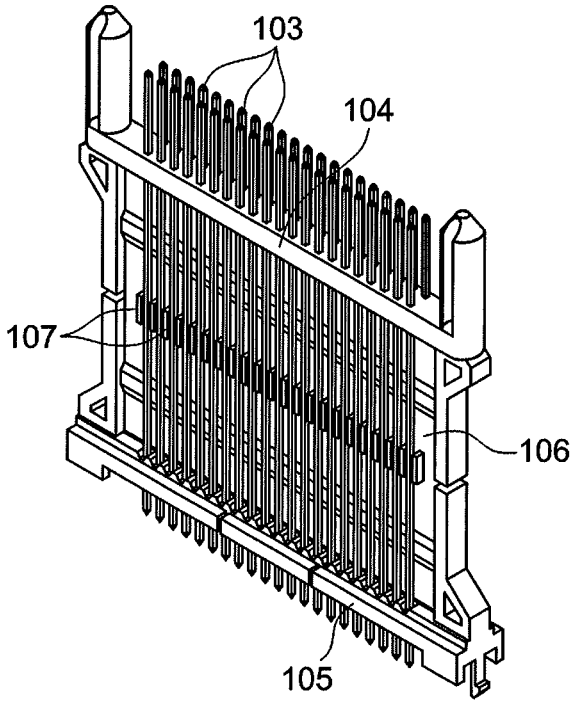
FIG. 29 is a perspective view of the conventional pin header.

The terminal pin 20X illustrated in FIGS. 23 to 25 can be fabricated by bending a single metal plate 210X having elasticity, illustrated in FIG. 26. The buffer zone 23X includes a resilient piece 231X which is able to deform to absorb deflection of an axis of the terminal pin 20X generated between one of the terminals 21 and the other terminal 21, and portions 232X and 233X both sandwiched between the claws 321 to keep the terminal pin 20X fixed in the storage room R when the terminal pin 20X is inserted into the aligner 32.

The resilient piece 231X has a width-reduced portion in which a width of the resilient piece 231X becomes smaller at a location closer to a center away from opposite ends of the resilient piece 231X.

The portions 232X and 233X are located at opposite ends of the resilient piece 231X, and are bent C-shaped. The portions 232X and 233X are identical in shape with the connecting portions 232 and 233 illustrated in FIG. 14.

The buffer zone 23X having the above-mentioned structure deforms to thereby absorb the deflection generated in the axis of the terminal pin 20X between the terminals 21 formed at opposite ends of the terminal pin 20X. Accordingly, when one of the terminals 21 is inserted into one of printed circuit boards after the other terminal 21 has been inserted into the other printed circuit board, an excessive stress does not act on the other terminal 21, even if a positional relation between the printed circuit boards is deflected.

Furthermore, since the projections 22 of the terminal pin 20 are designed to make contact with an outer side of the claws 231, the deflection in an axial direction is restricted by the projections 22 located closer to a printed circuit board into which the terminal 21 is inserted. Thus, even if the buffer zone 23X were weak at the width-reduced portion, it would be possible to insert the terminal pin 20X into the printed circuit boards P1 and P2 without problems.

While the present invention has been described in connection with the first and second embodiments, it is to be understood that the subject matter encompassed by way of the present invention is not to be limited to those specific embodiments. On the contrary, it is intended for, the subject matter of the invention to include all alternatives, modifications and equivalents as can be included within the spirit and scope of the following claims.

For instance, the terminals 21 are designed to be a press-fit terminal in the above-mentioned first and second embodiments, at least one of the terminals 21 may be designed to be a merely bar-shaped terminal, in which case, the terminal is necessary to be soldered to the printed circuit boards P1 and P2, but the terminals can be designed to be simple in structure, and the terminals can have a diameter smaller than the same of a press-fit terminal, ensuring that terminal pins can be aligned at a smaller pitch.

Though the electric connector is designed to include the terminal pins 20 aligned in a single row in the above-mentioned first and second embodiments, the electric connector may be designed to include the terminal pins 20 in a plurality of rows. For instance, the electric connector can include the terminal pins 20 in two rows by designing the support 31 to include the aligners 32 and the projections 33 at a rear thereof. Furthermore, the electric connector may be designed to include a plurality of the bases 30, in which case, the legs 34 of the bases 30 are connected to each other, ensuring the electric connector can include the terminal pins 20 in a desired number of rows.

In the first and second embodiments, the projections 22 are designed to make contact with outer sides of the claws 321 projecting from the support 31. As an alternative, the support 31 may be formed with an opening or a recess, and the projections 22 may be designed to make contact with a peripheral wall of the opening or recess located inside of the claws 321, ensuring that it is possible to restrict the deflection of the terminal pin 20 in an axial direction thereof.

INDUSTRIAL APPLICABILITY

In the present invention, the terminals formed at opposite ends of each of the terminal pins aligned in a row are inserted into through-holes formed through two printed circuit boards. Thus, the present invention is suitable to an electric connector electrically connecting printed circuit boards to each other, and can be broadly used in electric and electronic fields and in an automobile field as a connector to be used for electric or electronic parts to be inserted into a printed circuit board, or a connector to be equipped in an automobile.

The entire disclosure of Japanese Patent Application No. 2012-154902 filed on Jul. 10, 2012 including specification, claims, drawings and summary is incorporated herein by reference in its entirety.

What is claimed is:

1. An electric connector comprising:

an aligner for aligning terminal pins in a row; and at least one terminal pin of the terminal pins, said at least one terminal pin having:

terminals, located at opposite ends of said at least one terminal pin, to be inserted into through-holes formed through printed circuit boards spaced away from and facing each other, said terminals being coaxial with an axial line of the at least one terminal pin;

a buffer zone which is deformable in accordance with displacement of at least one of said terminals from the axial line of said at least one terminal pin; and two movement-limiters between which said buffer zone is formed, each of said two movement-limiters perpendicularly extending from said at least one terminal pin, and each of said movement-limiters restricting movement of said at least one terminal pin in a direction of the axial line thereof, wherein said buffer zone is disposed on the axial line between said terminals located at said opposite ends of said at least one terminal pin, said aligner includes a pair of claws extending from a support that guides said at least one terminal pin having been inserted thereinto to a storage space, said claws being resiliently deformed when said at least one terminal pin is inserted into said claws, and one of said claws aligns said at least one terminal pin such that said at least one terminal pin is not movable relative to said one claw, and another of said claws aligns said at least one terminal pin such that said at least one terminal pin is movable relative to said other claw.

2. The electric connector as set forth in claim 1, wherein said buffer zone comprises a plurality of resilient pieces.

3. The electric connector as set forth in claim 2, wherein said buffer zone has a central portion closer to the axial line of said at least one terminal pin than both ends of said buffer zone.

4. The electric connector as set forth in claim 1, wherein said buffer zone comprises a resilient piece including a smaller width portion than a rest of said resilient piece.

5. The electric connector as set forth in claim 1, wherein said aligner includes:

said support extending in a direction in which the terminal pins are aligned; and a projection extending into said storage space and keeping said at least one terminal pin in said storage space.

6. The electric connector as set forth in claim 1, wherein each of said movement-limiters includes a pair of projections making contact with one of inner and outer sides of said aligner to restrict movement of said at least one terminal pin in the direction of the axial line of said at least one terminal pin.

7. The electric connector as set forth in claim 1, wherein said buffer zone is deformable in any direction perpendicular to the axial line of said at least one terminal pin.

* * * * *